US005943879A

United States Patent [19]

Sada et al.

[11] Patent Number: 5,943,879

[45] Date of Patent: Aug. 31, 1999

[54] HEAT TRANSPORT SYSTEM

[75] Inventors: Shinri Sada; Yasushi Hori; Osamu Tanaka, all of Osaka, Japan

[73] Assignee: Daikin Industries, Ltd., Osaka, Japan

[21] Appl. No.: 09/051,484

[22] PCT Filed: Oct. 24, 1996

[86] PCT No.: PCT/JP96/03130

§ 371 Date: Apr. 17, 1998

§ 102(e) Date: Apr. 17, 1998

[87] PCT Pub. No.: WO97/15800

PCT Pub. Date: Jan. 5, 1997

[30] Foreign Application Priority Data

Oct. 24, 1995 [JP] Japan ..... 7-275642

[51] Int. Cl.[6] ..... F25D 11/00; F25D 15/00

[52] U.S. Cl. ..... 62/430; 62/119; 165/104.22

[58] Field of Search ..... 62/119, 185, 430; 165/104.24, 104.22

[56] References Cited

U.S. PATENT DOCUMENTS 4,517,808 5/1985 Movshovitz et al. ..... 62/185 X 5,052,472 10/1991 Takahashi et al. ..... 62/185 X

*Primary Examiner*—William Wayner

*Attorney, Agent, or Firm*—Sixbey, Friedman Leedom & Ferguson; Donald R. Studebaker

[57] ABSTRACT

A heat exchanger (1) on the secondary heat source, which exchanges heat with a heat exchanger (12) on the primary heat source in a primary cooling circuit (A), is connected with an indoor heat exchanger (3) through a gas pipe (6) and a liquid pipe (7), which are provided with solenoid valves (SV1, SV2), respectively. Only the solenoid valve (SV2) of the liquid pipe (7) is opened at the time of heat radiation of the heat exchanger (12) on the primary side and the liquid cooling medium is supplied from the heat exchanger (1) on the secondary side to the indoor heat exchanger (3) by the high vapor pressure of the cooling medium evaporated from the heat exchanger (1). Only the solenoid valve (SV1) of the gas pipe (6) is opened at the time of heat absorption of the heat exchanger (12) and the gas cooling medium is recovered from the indoor heat exchanger (3) to the heat exchanger (1) by the low vapor pressure of the cooling medium condensed by the heat exchanger (1).

15 Claims, 19 Drawing Sheets

HEAT TRANSPORT SYSTEM

TECHNICAL FIELD

The present invention relates to a heat transport system, which can be used as refrigerant circuitry for an air conditioning system, for example. More particularly, the present invention relates to a heat transport system for transporting heat by circulating a heat transport medium without requiring a driving source such as a pump.

BACKGROUND ART

As refrigerant circuitry for an air conditioning system, two-system refrigerant circuitry, such as that disclosed in Japanese Laid-Open Publication No. 62-238951, has conventionally been known. Refrigerant circuitry of this type includes: a primary refrigerant circuit in which a compressor, a heat exchanger on the first heat source side, a pressure reducing mechanism and a heat exchanger on the first application side are sequentially connected to each other through a refrigerant pipe; and a secondary refrigerant circuit in which a pump, a heat exchanger on the second heat source side and a heat exchanger on the second application side are connected to each other through a refrigerant pipe.

And, heat is exchanged between the heat exchanger on the first application side of the primary refrigerant circuit and the heat exchanger on the second heat source side of the secondary refrigerant circuit, and the heat exchanger on the second application side is disposed within a room to be air-conditioned.

In this refrigerant circuitry, during the room cooling running, a refrigerant is evaporated in the heat exchanger on the first application side and the refrigerant is condensed in the heat exchanger on the second heat source side. The condensed refrigerant exchanges heat with the indoor air in the heat exchanger on the second application side and is evaporated, thereby cooling the indoor air.

On the other hand, during the room heating running, a refrigerant is condensed in the heat exchanger on the first application side and the refrigerant is evaporated in the heat exchanger on the second heat source side. The evaporated refrigerant exchanges heat with the indoor air in the heat exchanger on the second application side and is condensed, thereby heating the indoor air.

In this way, the piping length of the primary refrigerant circuit is shortened, thereby trying to improve the refrigerating capacity.

However, in such an arrangement, a pump is required as a discrete driving source for circulating the refrigerant in the secondary refrigerant circuit. As a result, the power consumption and the like are increased. In addition, since such a driving source is required, the number of parts having such factors as to cause some failure is increased and thus the reliability of the entire system is adversely deteriorated.

As refrigerant circuitry for overcoming these problems, there exists a heat transport system of a so-called "non-powered" heat transport type, in which no driving source is provided for the secondary refrigerant circuit. Heat transport systems of such a type include a system disclosed in Japanese Laid-Open Publication No. 63-180022. In the heat transport system, a secondary refrigerant circuit is constructed such that a heater, a condenser and a sealed container are sequentially connected to each other through a refrigerant pipe and that the sealed container is disposed at a position higher than that of the heater. Moreover, the heater and the sealed container are connected to each other through an equalizer pipe including an opening/closing valve.

According to such an arrangement, during the room heating running, the opening/closing valve is first closed. A gaseous refrigerant heated by the heater is condensed in the condenser so as to be liquefied. Then, the liquid refrigerant is recovered into the sealed container. Thereafter, the opening/closing valve is opened, the pressure in the heater is equalized by the equalizer pipe with the pressure in the sealed container, and then the liquid refrigerant is recovered from the sealed container, disposed at a position higher than that of the heater, to the heater.

By repeating this operation, the circulation of the refrigerant is enabled without providing any driving source such as a pump for the secondary refrigerant circuit.

(Problems to be Solved)

However, in such a heat transport system, if the gaseous refrigerant flows from the condenser into the sealed container, then the pressure in the sealed container rises. As a result, there is some possibility that the operation of circulating the refrigerant cannot be performed satisfactorily. Thus, the refrigerant needs to be excessively cooled in the condenser so that the gaseous refrigerant does not flow out from the condenser.

Moreover, the heat transport system ameliorates the inner structure of the sealed container so as to suppress a rise in pressure within the sealed container. However, the system cannot be regarded as attaining sufficient reliability.

Furthermore, if the liquid refrigerant is to be introduced into the sealed container with certainty in this manner, then the condenser is required to be disposed at a position higher than that of the sealed container. Thus, since undue restriction is imposed on the positions where the respective units are disposed, it is difficult to apply such a system to a large-scale system or a system having a long pipe.

In view of this point, the present invention has been devised in order to accomplish an objective of alleviating the restriction on the positions where the units are disposed and attaining high reliability and universality for a heat transport system of a non-powered heat transport type requiring no driving source.

DISCLOSURE OF THE INVENTION

In order to accomplish the above-described objective, according to the present invention, pressure is applied to a refrigerant in a refrigerant circuit on an application side, and the refrigerant is circulated in the refrigerant circuit on the application side by utilizing this pressure. In addition, the direction in which the refrigerant circulates is controlled such that heat exchange means on the application side can perform a predetermined operation.

Specifically, the first solution provided by the present invention includes, first, heat exchange means (1) on a heat source side and heat exchange means (3) on an application side, as shown in FIG. 1. In addition, the solution also includes: a gas pipe (6) for connecting upper ends of the heat exchange means (1) on the heat source side and the heat exchange means (3) on the application side; and a liquid pipe (7) for connecting lower ends of the heat exchange means (1) on the heat source side and the heat exchange means (3) on the application side.

Moreover, the solution further includes heat source means (A) for alternately performing a heating operation for raising an internal pressure in the heat exchange means (1) on the heat source side by applying heat to a refrigerant in the heat exchange means (1) on the heat source side and a heat-absorbing operation for lowering the internal pressure in the heat exchange means (1) on the heat source side by extracting heat from the refrigerant in the heat exchange means (1) on the heat source side.

In addition, the solution further includes refrigerant control means (G) for performing heat absorption running or heat radiation running on the heat exchange means (3) on the application side by allowing the refrigerant to flow through one of the gas pipe (6) and the liquid pipe (7) and preventing the refrigerant from flowing through the other pipe in accordance with whether the heat source means (A) performs the heating operation or the heat-absorbing operation, thereby supplying the refrigerant from the heat exchange means (1) on the heat source side to the heat exchange means (3) on the application side during the heating operation of the heat source means (A) and recovering the refrigerant from the heat exchange means (3) on the application side to the heat exchange means (1) on the heat source side during the heat-absorbing operation of the heat source means (A).

In accordance with this first solution, while the heat source means (A) performs the heating operation, heat is applied to the refrigerant in the heat exchange means (1) on the heat source side and the internal pressure in the heat exchange means (1) on the heat source side rises. On the other hand, while the heat source means (A) performs the heat-absorbing operation, heat is extracted from the refrigerant in the heat exchange means (1) on the heat source side and the internal pressure in the heat exchange means (1) on the heat source side falls.

In accordance with this operation, the refrigerant control means (G) allows the refrigerant to flow through one of the gas pipe (6) and the liquid pipe (7) and prevents the refrigerant from flowing through the other pipe. Thus, the refrigerant circulates in a predetermined direction between the heat exchange means (1) on the heat source side and the heat exchange means (3) on the application side, and the heat absorption running or the heat radiation running is performed on the heat exchange means (3) on the application side. As a result, the refrigerant circulates owing to the heat exchange caused in the heat exchange means (1) on the heat source side.

Thus, in accordance with this first solution, the refrigerant in the heat exchanger means (1) on the heat source side is repeatedly subjected to heat absorption and heat radiation, and is made to circulate between the heat exchanger means (1) on the heat source side and the heat exchange means (3) on the application side by utilizing a variation in pressures of the refrigerant resulting therefrom. Accordingly, special transport means such as a refrigerant circulating pump for circulating the refrigerant is no longer necessary. As a result, the power consumption can be reduced, the number of parts having such factors as to cause some failure can also be reduced, and reliability can be ensured for the entire system.

In addition, the restriction on the positions where the units are disposed can be alleviated, thereby attaining high reliability and improving the universality thereof.

Moreover, since the heating and the heat-absorbing operations of the heat source means (A) are performed stably with respect to the heat exchange means (1) on the heat source side, the refrigerant can circulate satisfactorily even when the entire circuitry is formed in a large size. Consequently, the system can be enlarged.

In the second solution provided by the present invention, the first solution is adapted such that, in performing the heat absorption running on the heat exchange means (3) on the application side, the refrigerant control means (G) allows a liquid refrigerant to be supplied from the heat exchange means (1) on the heat source side to the heat exchange means (3) on the application side through the liquid pipe (7) and prevents a gaseous refrigerant from being recovered from the heat exchange means (3) on the application side to the heat exchange means (1) on the heat source side through the gas pipe (6) during the heating operation of the heat source means (A), and that the refrigerant control means (G) allows the gaseous refrigerant to be recovered from the heat exchange means (3) on the application side to the heat exchange means (1) on the heat source side through the gas pipe (6) and prevents the liquid refrigerant from being supplied from the heat exchange means (1) on the heat source side to the heat exchange means (3) on the application side through the liquid pipe (7) during the heat-absorbing operation of the heat source means (A).

In the second solution, during the heat absorption running of the heat exchange means (3) on the application side, the liquid refrigerant is supplied from the heat exchange means (1) on the heat source side to the heat exchange means (3) on the application side. The liquid refrigerant is evaporated in the heat exchange means (3) on the application side. The gaseous refrigerant is recovered from the heat exchange means (3) on the application side to the heat exchange means (1) on the heat source side. Thus, the heat-absorbing operation can be performed through the refrigerant evaporated in the heat exchange means (3) on the application side.

In accordance with the second solution, only the supply of the liquid refrigerant from the heat exchange means (1) on the heat source side to the heat exchange means (3) on the application side is allowed during the heating operation of the heat source means (A), and only the recovery of the gaseous refrigerant from the heat exchange means (3) on the application side to the heat exchange means (1) on the heat source side is allowed during the heat-absorbing operation of the heat source means (A), thereby performing heat absorption running on the heat exchange means (3) on the application side. Thus, this heat absorption running can be performed with certainty and reliability can be improved.

In the third solution provided by the present invention, the first solution is adapted such that, in performing the heat radiation running on the heat exchange means (3) on the application side, the refrigerant control means (G) allows a gaseous refrigerant to be supplied from the heat exchange means (1) on the heat source side to the heat exchange means (3) on the application side through the gas pipe (6) and prevents a liquid refrigerant from being recovered from the heat exchange means (3) on the application side to the heat exchange means (1) on the heat source side through the liquid pipe (7) during the heating operation of the heat source means (A), and that the refrigerant control means (G) allows the liquid refrigerant to be recovered from the heat exchange means (3) on the application side to the heat exchange means (1) on the heat source side through the liquid pipe (7) and prevents a gaseous refrigerant from being supplied from the heat exchange means (1) on the heat source side to the heat exchange means (3) on the application side through the gas pipe (6) during the heat-absorbing operation of the heat source means (A).

In the third solution, during the heat radiation running of the heat exchange means (3) on the application side, the gaseous refrigerant is supplied from the heat exchange means (1) on the heat source side to the heat exchange means (3) on the application side. The gaseous refrigerant is condensed in the heat exchange means (3) on the application side. The liquid refrigerant is recovered from the heat exchange means (3) on the application side to the heat exchange means (1) on the heat source side. Thus, the heat radiation running can be performed through the refrigerant condensed in the heat exchange means (3) on the application side.

In accordance with the third solution, only the supply of the gaseous refrigerant from the heat exchange means (1) on the heat source side to the heat exchange means (3) on the application side is allowed during the heating operation of the heat source means (A), and only the recovery of the liquid refrigerant from the heat exchange means (3) on the application side to the heat exchange means (1) on the heat source side is allowed during the heat-absorbing operation of the heat source means (A), thereby performing heat radiation running on the heat exchange means (3) on the application side. Thus, this heat radiation running can be performed with certainty and reliability can be improved.

In the fourth solution provided by the present invention, the first solution is adapted such that the heat exchange means (1) on the heat source side is formed by connecting at least one first heat exchanger (1*a*) and at least one second heat exchanger (1*b*) in parallel to each other.

And, while the heat source means (A) performs the heating operation during the heat absorption running of the heat exchange means (3) on the application side, only the first heat exchanger (1*a*) is heated to raise an internal pressure of the first heat exchanger (1*a*) and the pressure is applied onto the second heat exchanger (1*b*), thereby supplying a liquid refrigerant from the second heat exchanger (1*b*) to the heat exchange means (3) on the application side through the liquid pipe (7).

In the fourth solution, the internal pressure of the heated first heat exchanger (1*a*) rises and the pressure is applied onto the second heat exchanger (1*b*). As a result, the liquid refrigerant is supplied from the second heat exchanger (1*b*) to the heat exchange means (3) on the application side. That is to say, the first heat exchanger (1*a*) generates driving pressure for supplying the liquid refrigerant to the heat exchange means (3) on the application side.

In accordance with the fourth solution, only the first heat exchanger (1*a*) is heated to raise the internal pressure of the first heat exchanger (1*a*) and the pressure is applied onto the second heat exchanger (1*b*), thereby supplying a liquid refrigerant from the second heat exchanger (1*b*) to the heat exchange means (3) on the application side. Thus, the first heat exchanger (1*a*) can be made to generate driving pressure for supplying the liquid refrigerant. As a result, a refrigerant supply operation can be performed with certainty, while trying to reduce the heat quantity to be applied to the heat exchanger (1*a*).

In the fifth solution provided by the present invention, the first solution is adapted such that the heat exchange means (1) on the heat source side is formed by connecting at least one first heat exchanger (1*a*) and at least one second heat exchanger (1*b*) in parallel to each other.

And, while the heat source means (A) performs the heat-absorbing operation during the heat radiation running of the heat exchange means (3) on the application side, heat is absorbed only from the first heat exchanger (1*a*) to lower an internal pressure of the first heat exchanger (1*a*) and the pressure is applied onto the second heat exchanger (1*b*), thereby recovering a liquid refrigerant from the heat exchange means (3) on the application side to the second heat exchanger (1*b*) through the liquid pipe (7).

In the fifth solution, the internal pressure of the first heat exchanger (1*a*), the heat of which has been absorbed, is lowered and the pressure is applied onto the second heat exchanger (1*b*). As a result, the liquid refrigerant is recovered from the heat exchange means (3) on the application side to the second heat exchanger (1*b*). That is to say, the first heat exchanger (1*a*) generates driving pressure for recovering the liquid refrigerant from the heat exchange means (3) on the application side.

In accordance with the fifth solution, heat is absorbed only from the first heat exchanger (1*a*) to lower the internal pressure of the first heat exchanger (1*a*) and the pressure is applied onto the second heat exchanger (1*b*), thereby recovering a liquid refrigerant from the heat exchange means (3) on the application side to the second heat exchanger (1*b*). Thus, the first heat exchanger (1*a*) can be made to generate driving pressure for recovering the liquid refrigerant. As a result, a refrigerant recovery operation can be performed with certainty, while trying to reduce the heat quantity to be extracted from the heat exchanger (1*a*).

In the sixth solution provided by the present invention, the second or the fourth solution is adapted such that the refrigerant control means (G) is constituted by: a first solenoid valve (SV1) that is provided for the gas pipe (6), opens during the heat-absorbing operation of the heat source means (A) and closes during the heating operation thereof; and a second solenoid valve (SV2) that is provided for the liquid pipe (7), opens during the heating operation of the heat source means (A) and closes during the heat-absorbing operation thereof.

Also, in the seventh solution provided by the present invention, the third or the fifth solution is adapted such that the refrigerant control means (G) is constituted by: a first solenoid valve (SV1) that is provided for the gas pipe (6), opens during the heating operation of the heat source means (A) and closes during the heat-absorbing operation thereof; and a second solenoid valve (SV2) that is provided for the liquid pipe (7), opens during the heat-absorbing operation of the heat source means (A) and closes during the heating operation thereof.

Also, in the eighth solution provided by the present invention, the second or the fourth solution is adapted such that the refrigerant control means (G) is constituted by: a first check valve (CV1) that is provided for the gas pipe (6) and allows only the gaseous refrigerant to flow from the heat exchange means (3) on the application side to the heat exchange means (1) on the heat source side; and a second check valve (CV2) that is provided for the liquid pipe (7) and allows only the liquid refrigerant to flow from the heat exchange means (1) on the heat source side to the heat exchange means (3) on the application side.

Also, in the ninth solution provided by the present invention, the third or the fifth solution is adapted such that the refrigerant control means (G) is constituted by: a first check valve (CV3) that is provided for the gas pipe (6) and allows only the gaseous refrigerant to flow from the heat exchange means (1) on the heat source side to the heat exchange means (3) on the application side; and a second check valve (CV4) that is provided for the liquid pipe (7) and allows only the liquid refrigerant to flow from the heat exchange means (3) on the application side to the heat exchange means (1) on the heat source side.

Thus, in accordance with the sixth to the ninth solutions, specific arrangements for the refrigerant control means (G) can be obtained, the refrigerant circulation direction can be precisely set in order to perform the heat absorption running or the heat radiation running on the heat exchange means (3) on the application side, and reliability and practicality of the running operation can be improved.

In the tenth solution provided by the present invention, the first, second, third or fourth solution is adapted such that reservoir means (20), which is connected in parallel to the heat exchange means (1) on the heat source side and recovers the liquid refrigerant in the heat exchange means (1) on the heat source side, is further provided.

In accordance with the tenth solution, the liquid refrigerant in the heat exchange means (1) on the heat source side can be reserved in the reservoir means (20). Thus, the heat exchange efficiency of the heat exchange means (1) on the heat source side can be set at a high value, and the performance of the entire system can be improved.

In the eleventh solution provided by the present invention, the heat exchange means on the heat source side is constituted by a plurality of heat exchangers, thereby enabling to continuously perform heat radiation running or heat absorption running on the heat exchange means on the application side.

Specifically, the solution includes: at least one first heat exchange section (1A) on a heat source side; at least one second heat exchange section (1B) on the heat source side; and heat exchange means (3) on an application side.

And, the solution further includes: a plurality of gas pipes (6*a*, 6*b*) for connecting upper ends of the respective heat exchange sections (1A, 1B) on the heat source side to an upper end of the heat exchange means (3) on the application side; and a plurality of liquid pipes (7*a*, 7*b*) for connecting lower ends of the respective heat exchange sections (1A, 1B) on the heat source side to a lower end of the heat exchange means (3) on the application side.

Moreover, the solution further includes heat source means (A) for alternately performing a first heat exchange operation for raising an internal pressure of the first heat exchange section (1A) on the heat source side by applying heat to a refrigerant in the first heat exchange section (1A) on the heat source side and for lowering an internal pressure of the second heat exchange section (1B) on the heat source side by extracting heat from a refrigerant in the second heat exchange section (1B) on the heat source side, and a second heat exchange operation for lowering the internal pressure of the first heat exchange section (1A) on the heat source side by extracting heat from the refrigerant in the first heat exchange section (1A) on the heat source side and for raising the internal pressure of the second heat exchange section (1B) on the heat source side by applying heat to the refrigerant in the second heat exchange section (1B) on the heat source side.

In addition, the solution further includes refrigerant control means (G) for performing heat absorption running or heat radiation running on the heat exchange means (3) on the application side by switching flow conditions of the refrigerant in the gas pipes (6*a*, 6*b*) and the liquid pipes (7*a*, 7*b*) in accordance with the heat exchange operation of the heat source means (A), thereby supplying the refrigerant from the first heat exchange section (1A) on the heat source side to the heat exchange means (3) on the application side and recovering the refrigerant from the heat exchange means (3) on the application side to the second heat exchange section (1B) on the heat source side during the first heat exchange operation of the heat source means (A), and supplying the refrigerant from the second heat exchange section (1B) on the heat source side to the heat exchange means (3) on the application side and recovering the refrigerant from the heat exchange means (3) on the application side to the first heat exchange section (1A) on the heat source side during the second heat exchange operation of the heat source means (A).

In the eleventh solution, the refrigerant control means (G) prevents the refrigerant from flowing while making the heat source means (A) alternately perform the first heat exchange operation and the second heat exchange operation. As a result, a heat exchange section on the heat source side for supplying the refrigerant to the heat exchange means (3) on the application side and a heat exchange section on the heat source side for recovering the refrigerant from the heat exchange means (3) on the application side are alternately switched. Consequently, the heat absorption running or the heat radiation running of the heat exchange means (3) on the application side is performed continuously.

In accordance with the eleventh solution, since a heat exchange section on the heat source side for supplying the refrigerant to the heat exchange means (3) on the application side and a heat exchange section on the heat source side for recovering the refrigerant from the heat exchange means (3) on the application side are alternately switched, the heat absorption running or the heat radiation running of the heat exchange means (3) on the application side can be performed continuously. As a result, performance and practicality of the entire system can be improved.

In addition, since no special transport means for circulating the refrigerant between the heat exchange sections (1A, 1B) on the heat source side and the heat exchange means (3) on the application side is necessary, the power consumption can be reduced, the number of parts having such factors as to cause some failure can also be reduced and the reliability can be ensured for the entire system.

Moreover, the restriction on the positions where the units are disposed can be alleviated, thereby attaining high reliability and improving the universality thereof.

In the twelfth solution provided by the present invention, the eleventh solution is adapted such that, in performing the heat absorption running on the heat exchange means (3) on the application side, the refrigerant control means (G) switches the flow conditions of the refrigerant in the gas pipes (6*a*, 6*b*) and the liquid pipes (7*a*, 7*b*) so as to supply a liquid refrigerant from the first heat exchange section (1A) on the heat source side, heated by the heat source means (A), to the heat exchange means (3) on the application side through the liquid pipe (7*a*) and to recover a gaseous refrigerant from the heat exchange means (3) on the application side to the second heat exchange section (1B) on the heat source side, heat of which is absorbed by the heat source means (A), through the gas pipe (6*b*) during the first heat exchange operation of the heat source means (A), and that the refrigerant control means (G) switches the flow conditions of the refrigerant in the gas pipes (6*a*, 6*b*) and the liquid pipes (7*a*, 7*b*) so as to supply a liquid refrigerant from the second heat exchange section (1B) on the heat source side, heated by the heat source means (A), to the heat exchange means (3) on the application side through the liquid pipe (7*b*) and to recover a gaseous refrigerant from the heat exchange means (3) on the application side to the first heat exchange section (1A) on the heat source side, heat of which is absorbed by the heat source means (A), through the gas pipe (6*a*) during the second heat exchange operation of the heat source means (A).

In the twelfth solution, an operation of recovering the gaseous refrigerant from the heat exchange means (3) on the application side to the second heat exchange section (1B) on the heat source side while supplying the liquid refrigerant from the first heat exchange section (1A) on the heat source side to the heat exchange means (3) on the application side, and an operation of recovering the gaseous refrigerant from the heat exchange means (3) on the application side to the first heat exchange section (1A) on the heat source side while supplying the liquid refrigerant from the second heat exchange section (1B) on the heat source side to the heat exchange means (3) on the application side are alternately performed. As a result, the heat absorption running of the heat exchange means (3) on the application side is performed continuously.

Thus, in accordance with the twelfth solution, since the operations of supplying the liquid refrigerant from one heat exchange section (1A, 1B) on the heat source side to the heat exchange means (3) on the application side and simultaneously recovering the gaseous refrigerant from the heat exchange means (3) on the application side to the other heat exchange section (1A, 1B) on the heat source side are alternately performed, the heat absorption running of the heat exchange means (3) on the application side can be performed continuously. As a result, performance and practicality of the system itself can be improved.

In the thirteenth solution provided by the present invention, the eleventh solution is adapted such that, in performing the heat radiation running on the heat exchange means (3) on the application side, the refrigerant control means (G) switches the flow conditions of the refrigerant in the gas pipes (6*a*, 6*b*) and the liquid pipes (7*a*, 7*b*), thereby supplying a gaseous refrigerant from the first heat exchange section (1A) on the heat source side, heated by the heat source means (A), to the heat exchange means (3) on the application side through the gas pipe (6*a*) and recovering a liquid refrigerant from the heat exchange means (3) on the application side to the second heat exchange section (1B) on the heat source side, heat of which is absorbed by the heat source means (A), through the liquid pipe (7*b*) during the first heat exchange operation of the heat source means (A), and that the refrigerant control means (G) switches the flow conditions of the refrigerant in the gas pipes (6*a*, 6*b*) and the liquid pipes (7*a*, 7*b*), thereby supplying a gaseous refrigerant from the second heat exchange section (1B) on the heat source side, heated by the heat source means (A), to the heat exchange means (3) on the application side through the gas pipe (6*b*) and recovering a liquid refrigerant from the heat exchange means (3) on the application side to the first heat exchange section (1A) on the heat source side, heat of which is absorbed by the heat source means (A), through the liquid pipe (7*a*) during the second heat exchange operation of the heat source means (A).

In the thirteenth solution, an operation of recovering the liquid refrigerant from the heat exchange means (3) on the application side to the second heat exchange section (1B) on the heat source side while supplying the gaseous refrigerant from the first heat exchange section (1A) on the heat source side to the heat exchange means (3) on the application side, and an operation of recovering the liquid refrigerant from the heat exchange means (3) on the application side to the first heat exchange section (1A) on the heat source side while supplying the gaseous refrigerant from the second heat exchange section (1B) on the heat source side to the heat exchange means (3) on the application side are alternately performed. As a result, the heat radiation running of the heat exchange means (3) on the application side is performed continuously.

Thus, in accordance with the thirteenth solution, since the operations of supplying the gaseous refrigerant from one heat exchange section (1A, 1B) on the heat source side to the heat exchange means (3) on the application side and simultaneously recovering the liquid refrigerant from the heat exchange section (3) on the application side to the other heat exchange section (1A, 1B) on the heat source side are alternately performed, the heat radiation running of the heat exchange means (3) on the application side can be performed continuously. As a result, performance and practicality of the system itself can be improved.

In the fourteenth solution provided by the present invention, the eleventh or the twelfth solution is adapted such that each of the heat exchange sections (1A, 1B) on the heat source side is constituted by connecting at least one first heat exchanger (1*a*) and at least one second heat exchanger (1*b*) in parallel to each other.

And, in the heat exchange section (1A, 1B) on the heat source side that receives heat from the heat source means (A) during the heat absorption running of the heat exchange means (3) on the application side, only the first heat exchanger (1*a*) is heated to raise an internal pressure of the first heat exchanger (1*a*) and the pressure is applied onto the second heat exchanger (1*b*), thereby supplying a liquid refrigerant from the second heat exchanger (1*b*) to the heat exchange means (3) on the application side through the liquid pipe (7).

In the fourteenth solution, the internal pressure of the first heat exchanger (1*a*) of the heat exchange section (1A, 1B) on the heat source side that receives heat from the heat source means (A) rises and the pressure is applied onto the second heat exchanger (1*b*). As a result, the liquid refrigerant is supplied from the second heat exchanger (1*b*) to the heat exchange means (3) on the application side. That is to say, the first heat exchanger (1*a*) generates driving pressure for supplying the liquid refrigerant to the heat exchange means (3) on the application side.

In accordance with the fourteenth solution, only the first heat exchanger (1*a*) is heated to raise the internal pressure of the first heat exchanger (1*a*) and the pressure is applied onto the second heat exchanger (1*b*), thereby supplying a liquid refrigerant from the second heat exchanger (1*b*) to the heat exchange means (3) on the application side. Thus, the first heat exchanger (1*a*) can be made to generate driving pressure for supplying the liquid refrigerant. As a result, a refrigerant supply operation can be performed with certainty while trying to reduce the heat quantity to be applied to the heat exchanger (1*a*).

In the fifteenth solution provided by the present invention, the eleventh or the thirteenth solution is adapted such that each of the heat exchange sections (1A, 1B) on the heat source side is constituted by connecting at least one first heat exchanger (1*a*) and at least one second heat exchanger (1*b*) in parallel to each other.

And, in the heat exchange section (1A, 1B) on the heat source side, from which heat is extracted by the heat source means (A) during the heat radiation running of the heat exchange means (3) on the application side, only the first heat exchanger (1*a*) is cooled to lower an internal pressure of the heat exchanger (1*a*) and the pressure is applied onto the second heat exchanger (1*b*), thereby recovering a liquid refrigerant from the heat exchange means (3) on the application side to the heat exchanger (1*b*) through the liquid pipe (7).

In the fifteenth solution, the internal pressure of the first heat exchanger (1*a*) of the heat exchange section (1A, 1B) on the heat source side, from which heat is extracted by the heat source means (A), is lowered and the pressure is applied onto the second heat exchanger (1*b*). As a result, the liquid refrigerant is recovered from the heat exchange means (3) on the application side to the second heat exchanger (1*b*). That is to say, the first heat exchanger (1*a*) generates driving pressure for recovering the liquid refrigerant from the heat exchange means (3) on the application side.

In accordance with the fifteenth solution, heat is absorbed only from the first heat exchanger (1*a*) to lower the internal pressure of the first heat exchanger (1*a*) and the pressure is applied onto the second heat exchanger (1*b*), thereby recovering a liquid refrigerant from the heat exchange means (3) on the application side to the second heat exchanger (1*b*). Thus, the first heat exchanger (1*a*) can be made to generate driving pressure for recovering the liquid refrigerant. As a result, a refrigerant recovery operation can be performed with certainty while trying to reduce the heat quantity to be extracted from the heat exchanger (1*a*).

BEST MODE FOR CARRYING OUT THE INVENTION

Figure 1:
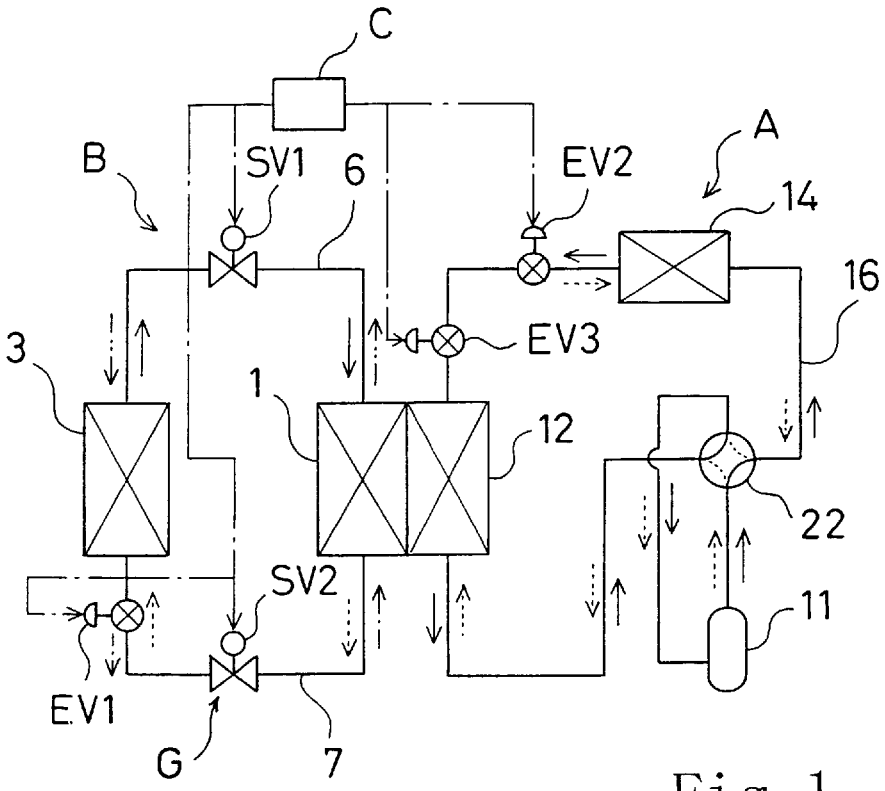
FIG. 1 is a diagram showing a general arrangement of refrigerant circuitry in the first and the second embodiments.

Hereinafter, embodiments of the present invention will be described with reference to the drawings. In each of the embodiments, two-system refrigerant circuitry including a primary refrigerant circuit and a secondary refrigerant circuit is provided, a refrigerant is circulated in the secondary refrigerant circuit by utilizing heat quantity applied from the primary refrigerant circuit to the secondary refrigerant circuit. And, in each of the embodiments, the present invention is applied to refrigerant circuitry for an air conditioning system for conditioning the indoor air by circulating the refrigerant.

(First Embodiment)

First, the first embodiment will be described with reference to FIG. 1.

This embodiment is applied to an air conditioning system exclusively used for cooling. FIG. 1 shows the entire refrigerant circuitry as a heat transport system of this embodiment. As shown in FIG. 1, this refrigerant circuitry is constructed such that a refrigerant in a primary refrigerant circuit (A) functioning as heat source means exchanges heat with a refrigerant in a secondary refrigerant circuit (B).

First, the secondary refrigerant circuit (B) for cooling the indoor air by exchanging heat with the indoor air will be described.

The secondary refrigerant circuit (B) is constructed such that an indoor heat exchanger (3) disposed in a room to be air-conditioned as heat exchange means on the application side and a heat exchanger (1) on the secondary heat source side functioning as heat exchange means on the heat source side for exchanging heat with the primary refrigerant circuit (A) are connected through a gas pipe (6) and a liquid pipe (7), and is formed as a closed circuit in which a refrigerant circulates. The gas pipe (6) is connected to the upper parts of the indoor heat exchanger (3) and the heat exchanger (1) on the secondary heat source side, and the liquid pipe (7) is connected to the lower parts of the indoor heat exchanger (3) and the heat exchanger (1) on the secondary heat source side.

A first solenoid valve (SV1) and a second solenoid valve (SV2) are provided for the gas pipe (6) and the liquid pipe (7), respectively. An indoor electrically motorized expansion valve (EV1) is provided for the liquid pipe (7) between the indoor heat exchanger (3) and the second solenoid valve (SV2). Refrigerant control means (G) is constituted by the respective solenoid valves (SV1, SV2).

Next, the primary refrigerant circuit (A) functioning as heat source means for applying heat quantity to the secondary refrigerant circuit (B) will be described.

The primary refrigerant circuit (A) is constructed by connecting a compressor (11), a four-position selector valve (22), an outdoor heat exchanger (14) and a heat exchanger (12) on the primary heat source side to each other through a refrigerant pipe (16). The primary refrigerant circuit (A) is switched in accordance with the switching operation of the four-position selector valve (22) between a state where the outdoor heat exchanger (14) is connected to the outlet side of the compressor (11) and the heat exchanger (12) on the primary heat source side is connected to the inlet side of the compressor (11) (i.e., the state indicated by solid lines in FIG. 1) and a state where the outdoor heat exchanger (14) is connected to the inlet side of the compressor (11) and the heat exchanger (12) on the primary heat source side is connected to the outlet side of the compressor (11) (i.e., the state indicated by broken lines in FIG. 1). A first and a second outdoor electrically motorized expansion valve (EV2, EV3) are provided between the outdoor heat exchanger (14) and the heat exchanger (12) on the primary heat source side.

The opening/closing states of the respective solenoid valves (SV1, SV2), the electrically motorized expansion valves (EV1, EV2, EV3) and the four-position selector valve (22) are controlled by a controller (C).

Next, the cooling running operations of the primary refrigerant circuit (A) and the secondary refrigerant circuit (B) will be described.

When the cooling running is started, the four-position selector valve (22) is first switched to the direction indicated by the solid lines, the first outdoor electrically motorized expansion valve (EV2) is fully opened and the opening degree of the second outdoor electrically motorized expansion valve (EV3) is adjusted at a predetermined degree in the primary refrigerant circuit (A). On the other hand, in the secondary refrigerant circuit (B), the first solenoid valve (SV1) is opened and the second solenoid valve (SV2) is closed.

In such a state, the compressor (11) is driven. Then, in the primary refrigerant circuit (A) as indicated by the solid-line arrows in FIG. 1, a high-temperature, high-pressure gaseous refrigerant discharged from the compressor (11) exchanges heat with the outdoor air in the outdoor heat exchanger (14) and is condensed. The pressure of the refrigerant is reduced in the second electrically motorized expansion valve (EV3). The refrigerant exchanges heat in the heat exchanger (12) on the primary heat source side with the heat exchanger (1) on the secondary heat source side. And the refrigerant extracts heat from the refrigerant in the heat exchanger (1) on the secondary heat source side and is evaporated to return to the compressor (11). This circulation operation is repeated.

On the other hand, in the secondary refrigerant circuit (B), the refrigerant in the heat exchanger (1) on the secondary heat source side, the heat of which has been extracted because of the heat exchange with the heat exchanger (12) on the primary heat source side, is condensed. As a result, the internal pressure of the heat exchanger (1) on the secondary heat source side falls. Owing to a difference in pressure between the heat exchanger (1) on the secondary heat source side and the indoor heat exchanger (3), the gaseous refrigerant in the indoor heat exchanger (3) is recovered into the heat exchanger (1) on the secondary heat source side through the gas pipe (6). The gaseous refrigerant recovered into the heat exchanger (1) on the secondary heat source side is cooled by the refrigerant flowing through the heat exchanger (12) on the primary heat source side so as to be a liquid refrigerant, which is reserved in the heat exchanger (1) on the secondary heat source side.

After this operation has been performed, a switching operation is performed in each of the refrigerant circuits (A, B). The four-position selector valve (22) is switched to the direction indicated by the broken lines, the second outdoor electrically motorized expansion valve (EV3) is fully opened and the opening degree of the first outdoor electrically motorized expansion valve (EV2) is adjusted at a predetermined degree. On the other hand, the first solenoid valve (SV1) is closed and the second solenoid valve (SV2) is opened.

As a result, in the primary refrigerant circuit (A) as indicated by the broken-line arrows in FIG. 1, the high-temperature, high-pressure gaseous refrigerant discharged from the compressor (11) exchanges heat in the heat exchanger (12) on the primary heat source side with the heat exchanger (1) on the secondary heat source side and is condensed while applying heat to the refrigerant in the heat exchanger (1) on the secondary heat source side. Thereafter, the pressure of the refrigerant is reduced in the first outdoor electrically motorized expansion valve (EV2). The refrigerant exchanges heat with the outdoor air in the outdoor heat exchanger (14) and is evaporated to return to the compressor (11). This circulation operation is repeated.

On the other hand, in the secondary refrigerant circuit (B), a part of the refrigerant in the heat exchanger (1) on the secondary heat source side, to which heat has been applied because of the heat exchange with the heat exchanger (12) on the primary heat source side, is evaporated. As a result, the internal pressure of the heat exchanger (1) on the secondary heat source side rises. Owing to a difference in pressures between the heat exchanger (1) on the secondary heat source side and the indoor heat exchanger (3), the liquid refrigerant in the heat exchanger (1) on the secondary heat source side is pushed from the lower part of the heat exchanger (1) on the secondary heat source side into the indoor heat exchanger (3) through the liquid pipe (7). The pressure of the liquid refrigerant pushed into the indoor heat exchanger (3) is reduced in the indoor electrically motorized expansion valve (EV1). Thereafter, the liquid refrigerant exchanges heat with the indoor air in the indoor heat exchanger (3) and is evaporated, thereby cooling the indoor air.

The switching operations are alternately performed in the respective refrigerant circuits (A, B) in the above-described manner. The refrigerant circulates in the refrigerant circuit (B), thereby cooling the indoor air.

Thus, in this embodiment, heat can be transported in the secondary refrigerant circuit (B) without providing any driving source such as a pump for the secondary refrigerant circuit (B). This makes it possible to reduce the power consumption and the number of parts having such factors as to cause some failure, thereby ensuring reliability for the entire system.

In addition, since the restriction on the positions at which units are disposed can be alleviated, high reliability and universality can be attained.

Moreover, since the heat absorption and radiation operations are performed stably in the secondary refrigerant circuit (B), a refrigerant can be circulated satisfactorily even when the secondary refrigerant circuit (B) is formed in a large size. As a result, the system can be enlarged.

(Second Embodiment)

Hereinafter, the second embodiment of the present invention will be described.

The circuitry of this embodiment has the same configuration as that of the first embodiment described above, and implements an air conditioning system exclusively used for heating.

Hereinafter, the heating running operation of this embodiment will be described with reference to FIG. 1.

When the heating running is started, the four-position selector valve (22) is first switched to the direction indicated by the solid lines, the first outdoor electrically motorized expansion valve (EV2) is fully opened and the opening degree of the second outdoor electrically motorized expansion valve (EV3) is adjusted at a predetermined degree in the primary refrigerant circuit (A). On the other hand, in the secondary refrigerant circuit (B), the first solenoid valve (SV1) is closed and the second solenoid valve (SV2) is opened.

Then, in the primary refrigerant circuit (A) as indicated by the solid-line arrows in FIG. 1, the high-temperature, high-pressure gaseous refrigerant discharged from the compressor (11) is condensed in the outdoor heat exchanger (14). Thereafter, the pressure of the refrigerant is reduced in the second electrically motorized expansion valve (EV3). The refrigerant exchanges heat in the heat exchanger (12) on the primary heat source side with the heat exchanger (1) on the secondary heat source side and is evaporated to return to the compressor (11). This circulation operation is repeated.

On the other hand, in the secondary refrigerant circuit (B), the refrigerant in the heat exchanger (1) on the secondary heat source side, the heat of which has been extracted because of the heat exchange with the heat exchanger (12) on the primary heat source side, is condensed as indicated by the one-dot-chain arrows. As a result, the internal pressure of the heat exchanger (1) on the secondary heat source side falls. Owing to a difference in pressures between the heat exchanger (1) on the secondary heat source side and the indoor heat exchanger (3), the liquid refrigerant in the indoor heat exchanger (3) is recovered into the heat exchanger (1) on the secondary heat source side through the liquid pipe (7).

After this operation has been performed, switching operations are performed in the respective refrigerant circuits (A, B). The four-position selector valve (22) is switched to the direction indicated by the broken lines, the second outdoor electrically motorized expansion valve (EV3) is fully opened and the opening degree of the first outdoor electrically motorized expansion valve (EV2) is adjusted at a predetermined degree. On the other hand, the first solenoid valve (SV1) is opened and the second solenoid valve (SV2) is closed.

Then, in the primary refrigerant circuit (A) as indicated by the broken-line arrows, the high-temperature, high-pressure gaseous refrigerant discharged from the compressor (11) is condensed in the heat exchanger (12) on the primary heat source side. Thereafter, the pressure of the refrigerant is reduced in the first: electrically motorized expansion valve (EV2). The refrigerant is evaporated in the outdoor heat exchanger (14) and then return to the compressor (11). This circulation operation is repeated.

On the other hand, in the secondary refrigerant circuit (B) as indicated by the two-dot-chain arrows, the refrigerant in the heat exchanger (1) on the secondary heat source side, to which heat has been applied because of the heat exchange with the heat exchanger (12) on the primary heat source side, is evaporated. As a result, the internal pressure of the heat exchanger (1) on the secondary heat source side rises. Owing to a difference in pressures between the heat exchanger (1) on the secondary heat source side and the indoor heat exchanger (3), the gaseous refrigerant in the heat exchanger (1) on the secondary heat source side is supplied from the upper part of the heat exchanger (1) on the secondary heat source side to the indoor heat exchanger (3) through the gas pipe (6). Thereafter, the gaseous refrigerant supplied to the indoor heat exchanger (3) exchanges heat with the indoor air in the indoor heat exchanger (3) and is condensed, thereby heating the indoor air.

The switching operations are alternately performed in the respective refrigerant circuits (A, B) in the above-described manner, whereby the refrigerant circulates in the secondary refrigerant circuit (B) and the indoor air is heated. That is to say, even during this heating running, heat can be transported in the secondary refrigerant circuit (B) without providing any driving source such as a pump for the secondary refrigerant circuit (B).

(Variants of Secondary Refrigerant Circuit)

In the following third to twelfth embodiments, variants of the secondary refrigerant circuit (B), which can be combined with the primary refrigerant circuit (A) described above, will be described.

(Third Embodiment)

The secondary refrigerant circuit (B) of this embodiment includes check valves (CV1, CV2) instead of the solenoid valves (SV1, SV2) of the first embodiment described above, and constitutes a secondary refrigerant circuit (B) for an air conditioning system exclusively used for cooling.

Figure 2:
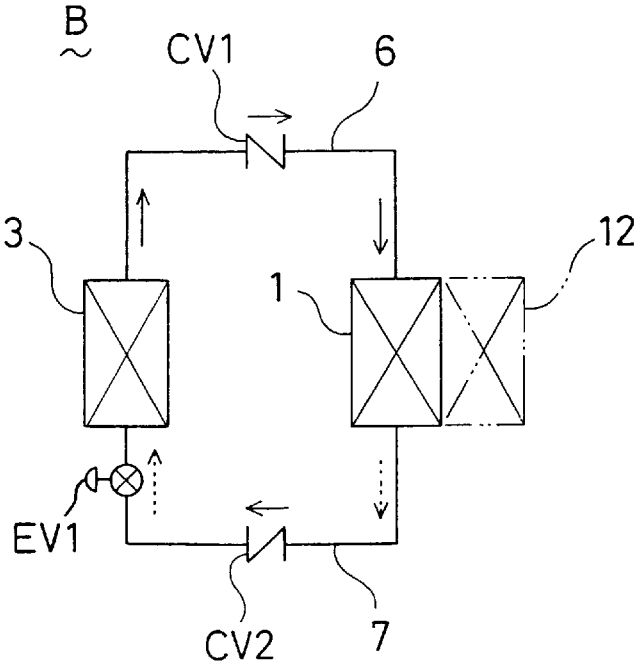
FIG. 2 is a diagram showing a secondary refrigerant circuit in the third embodiment.

The secondary refrigerant circuit (B) will be described. As shown in FIG. 2, a check valve (CV1) allowing only a gaseous refrigerant to flow from the indoor heat exchanger (3) to the heat exchanger (1) on the secondary heat source side is provided for the gas pipe (6) and a check valve (CV2) allowing only a liquid refrigerant to flow from the heat exchanger (1) on the secondary heat source side to the indoor heat exchanger (3) is provided for the liquid pipe (7).

During the cooling running of this embodiment, the operations of switching the four-position selector valve (22) and the electrically motorized expansion valves (EV2, EV3) are performed in the primary refrigerant circuit (A) in the same way as in the first embodiment described above. The refrigerant circulates in the secondary refrigerant circuit (B) owing to a pressure difference, which is caused between the heat exchanger (1) on the secondary heat source side and the indoor heat exchanger (3) in accordance with them (see the solid-line and broken-line arrows shown in FIG. 2).

Also, in this embodiment, no solenoid valves are provided for the secondary refrigerant circuit (B). That is to say, only by performing the operations of switching the four-position selector valve (22) and the electrically motorized expansion valves (EV2, EV3) in the primary refrigerant circuit (A), the refrigerant in the secondary refrigerant circuit (B) is circulated.

(Fourth Embodiment)

The secondary refrigerant circuit (B) of this embodiment includes check valves instead of the solenoid valves (SV1, SV2) of the second embodiment described above, and constitutes a secondary refrigerant circuit (B) for an air conditioning system exclusively used for heating.

Figure 3:
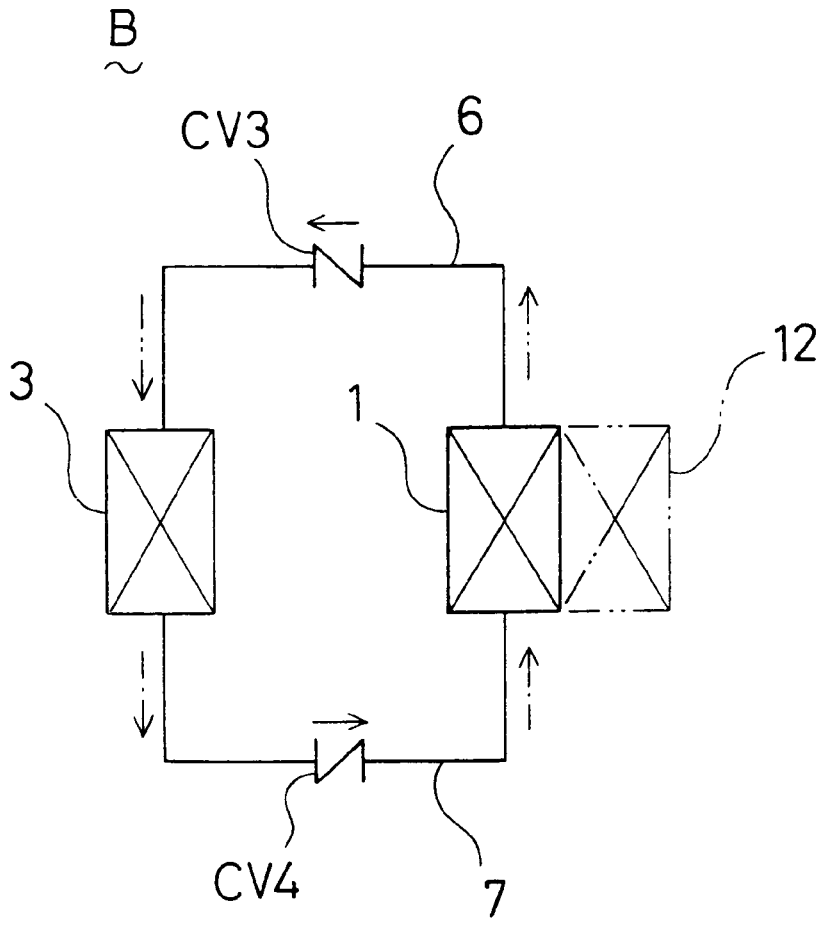
FIG. 3 is a diagram corresponding to FIG. 2 in the fourth embodiment.

The secondary refrigerant circuit (B) will be described. As shown in FIG. 3, a check valve (CV3) allowing only a gaseous refrigerant to flow from the heat exchanger (1) on the secondary heat source side to the indoor heat exchanger (3) is provided for the gas pipe (6) and a check valve (CV4) allowing only a liquid refrigerant to flow from the indoor heat exchanger (3) to the heat exchanger (1) on the secondary heat source side is provided for the liquid pipe (7).

During the heating running of this embodiment, the operations of switching the four-position selector valve (22) and the electrically motorized expansion valves (EV2, EV3) are performed in the primary refrigerant circuit (A) in the same way as in the second embodiment described above. The refrigerant circulates in the secondary refrigerant circuit (B) owing to a pressure difference, which is caused between the heat exchanger (1) on the secondary heat source side and the indoor heat exchanger (3) in accordance with them (see the one-dot-chain and two-dot-chain arrows shown in FIG. 2).

Also, in this embodiment, no solenoid valves are provided for the secondary refrigerant circuit (B). That is to say, only by performing the operations of switching the four-position selector valve (22) and the electrically motorized expansion valves (EV2, EV3) in the primary refrigerant circuit (A), the refrigerant in the secondary refrigerant circuit (B) is circulated.

(Fifth Embodiment)

The secondary refrigerant circuit (B) of this embodiment provides check valves for the respective pipes (6, 7), and constitutes the heat exchanger (1) on the secondary heat source side by a pair of heat exchangers (1*a*, 1*b*). And, this embodiment constitutes a secondary refrigerant circuit (B) for an air conditioning system exclusively used for cooling.

Figure 4:
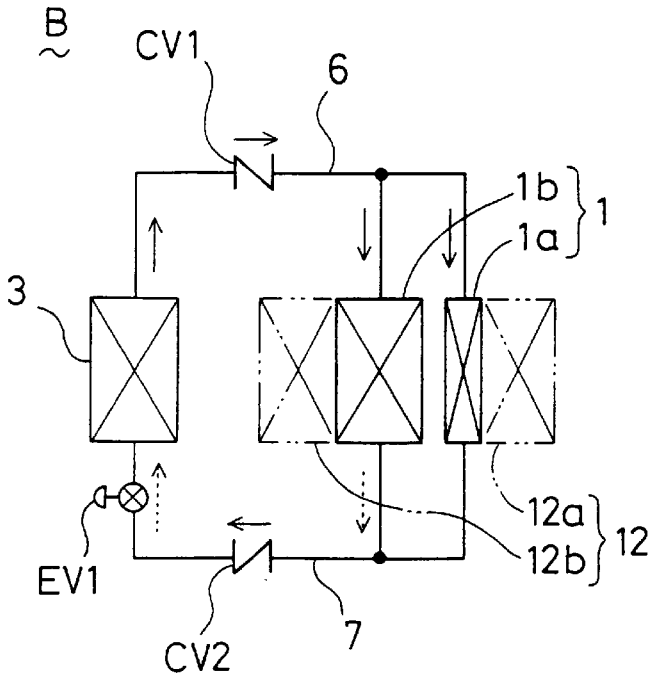
FIG. 4 is a diagram corresponding to FIG. 2 in the fifth embodiment.

The secondary refrigerant circuit (B) will be described. As shown in FIG. 4, a check valve (CV1) allowing only a gaseous refrigerant to flow from the indoor heat exchanger (3) to the heat exchanger (1) on the secondary heat source side is provided for the gas pipe (6) and a check valve (CV2) allowing only a liquid refrigerant to flow from the heat exchanger (1) on the secondary heat source side to the indoor heat exchanger (3) is provided for the liquid pipe (7) in the same way as in the third embodiment described above.

The heat exchanger (1) on the secondary heat source side is constituted by a first and a second heat exchanger (1*a*, 1*b*) on the secondary heat source side, which are connected in parallel to each other. The respective heat exchangers (1*a*, 1*b*) exchange heat with the heat exchanger (12) on the primary heat source side.

On the other hand, the heat exchanger (12) on the primary heat source side is also constituted by a pair of heat exchangers (12*a*, 12*b*) so as to correspond to the respective heat exchangers (1*a*, 1*b*) on the secondary heat source side. The respective heat exchangers (12*a*, 12*b*) individually exchange heat with the heat exchangers (1*a*, 1*b*) on the secondary heat source side, respectively. It is noted that the first heat exchanger (1*a*) on the secondary heat source side is formed in a smaller size than that of the second heat exchanger (1*b*) on the secondary heat source side.

The refrigerant circulation operation in the secondary refrigerant circuit (B) during the cooling running is as follows.

The refrigerant in each of the heat exchangers (1*a*, 1*b*) on the secondary heat source side, the heat of which has been exchanged with the refrigerant evaporated in the corresponding one of the heat exchangers (12*a*, 12*b*) on the primary heat source side and extracted therefrom, is condensed. As a result, the internal pressures of the heat exchangers (1*a*, 1*b*) on the secondary heat source side fall. As a result, as indicated by the solid-line arrows in FIG. 4, the gaseous refrigerant in the indoor heat exchanger (3) is recovered into each of the heat exchangers (1*a*, 1*b*) on the secondary heat source side through the gas pipe (6) and is cooled so as to be reserved as a liquid refrigerant.

Thereafter, when switching is performed in the primary refrigerant circuit (A), heat is exchanged only between one heat exchanger (12*a*) on the primary heat source side and the first heat exchanger (1*a*) on the secondary heat source side. The refrigerant in the first heat exchanger (1*a*) on the secondary heat source side, to which heat has been applied from the heat exchanger (12*a*) on the primary heat source side, is evaporated. As a result, the internal pressure thereof rises. The pressure is applied onto the second heat exchanger (1*b*) on the secondary heat source side. As a result, as indicated by the broken-line arrows in FIG. 4, the liquid refrigerant reserved in the second heat exchanger (1*b*) on the secondary heat source side is supplied to the indoor heat exchanger (3) through the liquid pipe (7). The pressure of the liquid refrigerant supplied to the indoor heat exchanger (3) is reduced in the indoor electrically motorized expansion valve (EV1). Thereafter, the liquid refrigerant exchanges heat with the indoor air in the indoor heat exchanger (3) and is evaporated, thereby cooling the indoor air.

The above-described operation is performed alternately and repeatedly. As a result, the refrigerant is circulated in the secondary refrigerant circuit (B), thereby cooling the indoor air. Thus, in this embodiment, the heat exchanger (1) on the secondary heat source side is constituted by a pair of heat exchangers (1*a*, 1*b*). One of them is used for reserving the liquid refrigerant to be supplied to the indoor heat exchanger (3) and the other is used for generating a pressure as driving force for supplying the liquid refrigerant.

(Sixth Embodiment)

The secondary refrigerant circuit (B) of this embodiment provides check valves for the respective pipes (6, 7), and constitutes the heat exchanger (1) on the secondary heat source side by a pair of heat exchangers (1*a*, 1*b*). And, this embodiment constitutes a secondary refrigerant circuit (B) for an air conditioning system exclusively used for cooling.

Figure 5:
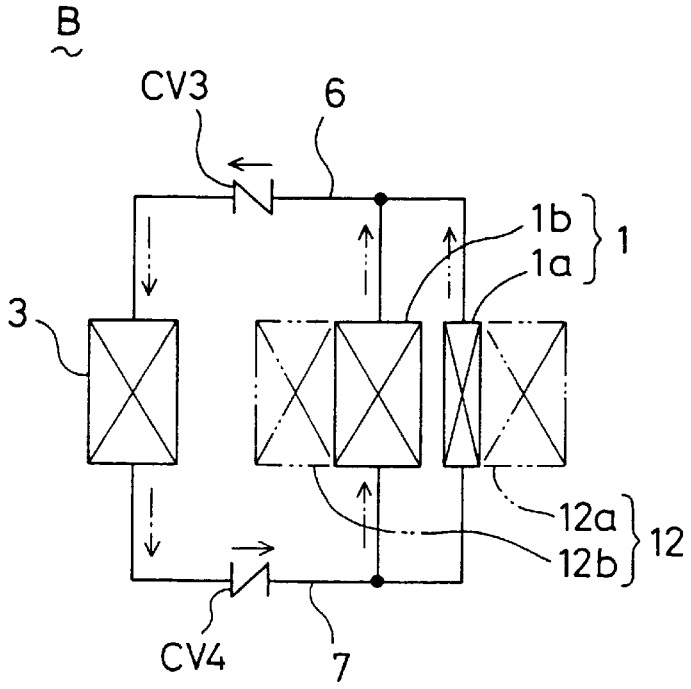
FIG. 5 is a diagram corresponding to FIG. 2 in the sixth embodiment.

The secondary refrigerant circuit (B) will be described. As shown in FIG. 5, a check valve (CV3) allowing only a gaseous refrigerant to flow from the heat exchanger (1) on the secondary heat source side to the indoor heat exchanger (3) is provided for the gas pipe (6) and a check valve (CV4) allowing only a liquid refrigerant to flow from the indoor heat exchanger (3) to the heat exchanger (1) on the secondary heat source side is provided for the liquid pipe (7) in the same way as in the fourth embodiment described above. The heat exchanger (1) on the secondary heat source side is the same as that of the above-described system exclusively used for cooling.

The refrigerant circulation operation in the secondary refrigerant circuit (B) during the heating running is as follows.

First, heat is exchanged only between one heat exchanger (1*a*) on the primary heat source side and the first heat exchanger (1*a*) on the secondary heat source side. The refrigerant in the first heat exchanger (1*a*) on the secondary heat source side, the heat of which has been exchanged with the refrigerant evaporated in the heat exchanger (12*a*) on the primary heat source side and extracted therefrom, is condensed. As a result, the internal pressure of the first heat exchanger (1*a*) on the secondary heat source side falls, and the internal pressure of the second heat exchanger (1*b*) on the secondary heat source side also falls correspondingly. Accordingly, as indicated by the one-dot-chain arrows shown in FIG. 5, the liquid refrigerant in the indoor heat exchanger (3) is recovered into the heat exchanger (1*b*) on the secondary heat source side through the liquid pipe (7).

Thereafter, when switching is performed in the primary refrigerant circuit (A), heat is exchanged between the heat exchangers (12*a*, 12*b*) on the primary heat source side and corresponding heat exchangers (1*a*, 1*b*) on the secondary heat source side. The refrigerant in each of the heat exchangers (1*a*, 1*b*) on the secondary heat source side, to which heat has been applied from the corresponding heat exchanger (12*a*, 12*b*) on the primary heat source side, is evaporated. As a result, the internal pressure thereof rises. As a result, as indicated by the two-dot-chain arrows in FIG. 5, the liquid refrigerant reserved in the heat exchangers (1*a*, 1*b*) on the secondary heat source side is evaporated and supplied to the indoor heat exchanger (3) through the gas pipe (6). The gaseous refrigerant supplied to the indoor heat exchanger (3) exchanges heat with the indoor air in the indoor heat exchanger (3) and is condensed, thereby heating the indoor air. The room is heated in this manner.

(Seventh Embodiment)

The secondary refrigerant circuit (B) of this embodiment is provided with a plurality of (two, in this embodiment) the heat exchangers (1) on the secondary heat source side, each of which includes a pair of heat exchangers (1*a*, 1*b*) as described in the fifth embodiment, thereby constituting a secondary refrigerant circuit (B) for an air conditioning system exclusively used for cooling.

The secondary refrigerant circuit (B) will be described.

Figure 6:
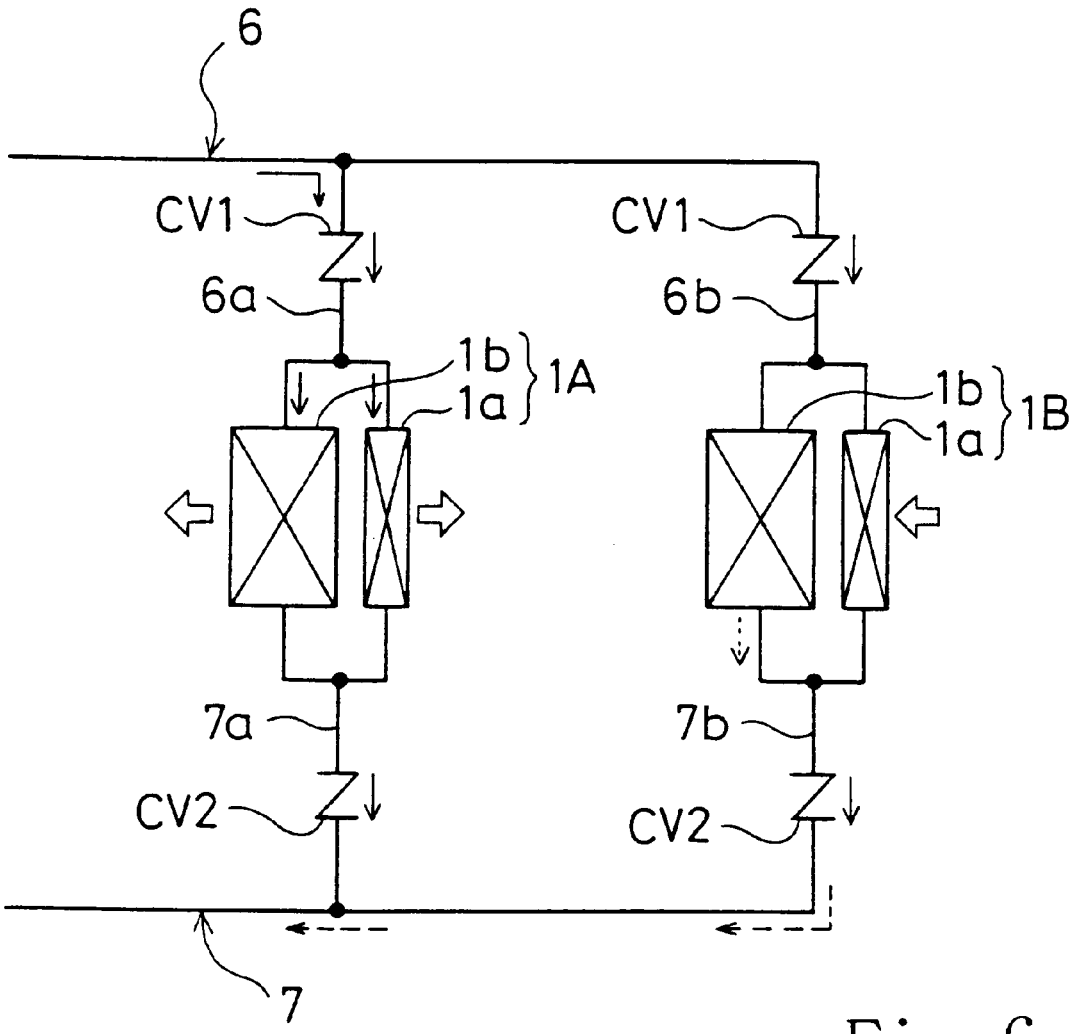
FIG. 6 is a diagram showing a part of a secondary refrigerant circuit in the seventh embodiment.

As shown in FIG. 6, the gas pipe (6) is branched into two branch pipes (6*a*, 6*b*) and the liquid pipe (7) is also branched into two branch pipes (7*a*, 7*b*). Check valves (CV1, CV1) allowing only the gaseous refrigerant to flow from the indoor heat exchanger (3) to the respective heat exchangers (1A, 1B) on the secondary heat source side are provided for the respective branch pipes (6*a*, 6*b*) of the gas pipe (6).

Check valves (CV2, CV2) allowing only the liquid refrigerant to flow from the respective heat exchangers (1A, 1B) on the secondary heat source side to the indoor heat exchanger (3) are provided for the respective branch pipes (7*a*, 7*b*) of the liquid pipe (7).

Each of the heat exchangers (1A, 1B) on the secondary heat source side is constituted by a first and a second primary heat exchanger (1*a*, 1*b*), which are connected in parallel to each other. The respective heat exchangers (1*a*, 1*b*) exchange heat with the heat exchanger on the primary heat source side (not shown, see FIG. 4).

Next, the refrigerant circulation operation in the secondary refrigerant circuit (B) during the cooling running will be described.

Switching is performed in the primary refrigerant circuit (A) such that while condensation of a refrigerant (heat-radiation operation) is being performed in one heat exchanger (1A) on the secondary heat source side, evaporation of a refrigerant (heat absorption operation) is performed in the other heat exchanger (1B) on the secondary heat source side. The heat-radiation state and the heat-absorption state are alternately and repeatedly established for both the heat exchangers (1A, 1B) on the secondary heat source side, whereby the refrigerant circulation operation is performed continuously.

Specifically, while the heat exchanger (1A) on the secondary heat source side, located on the left-hand side in FIG. 6, is in the heat-radiation state and is recovering the gaseous refrigerant from the indoor heat exchanger (3) (see the solid-line arrows in FIG. 6), the first heat exchanger (1*a*) on the secondary heat source side of the heat exchanger (1B) on the secondary heat source side, located on the right-hand side, is in the heat-absorption state. As a result, owing to the rise in internal pressure resulting from the evaporation of the refrigerant, the internal pressure is applied onto the second heat exchanger (1*b*) on the secondary heat source side. The second heat exchanger (1*b*) on the secondary heat source side supplies the liquid refrigerant to the indoor heat exchanger (3)(see the broken-line arrows in FIG. 6).

Thereafter, the heat-radiation state and the heat-absorption state are alternately and repeatedly established for both the heat exchangers (1A, 1B) on the secondary heat source side, whereby the indoor air is cooled continuously and the air conditioning performance can be improved.

Figure 7:
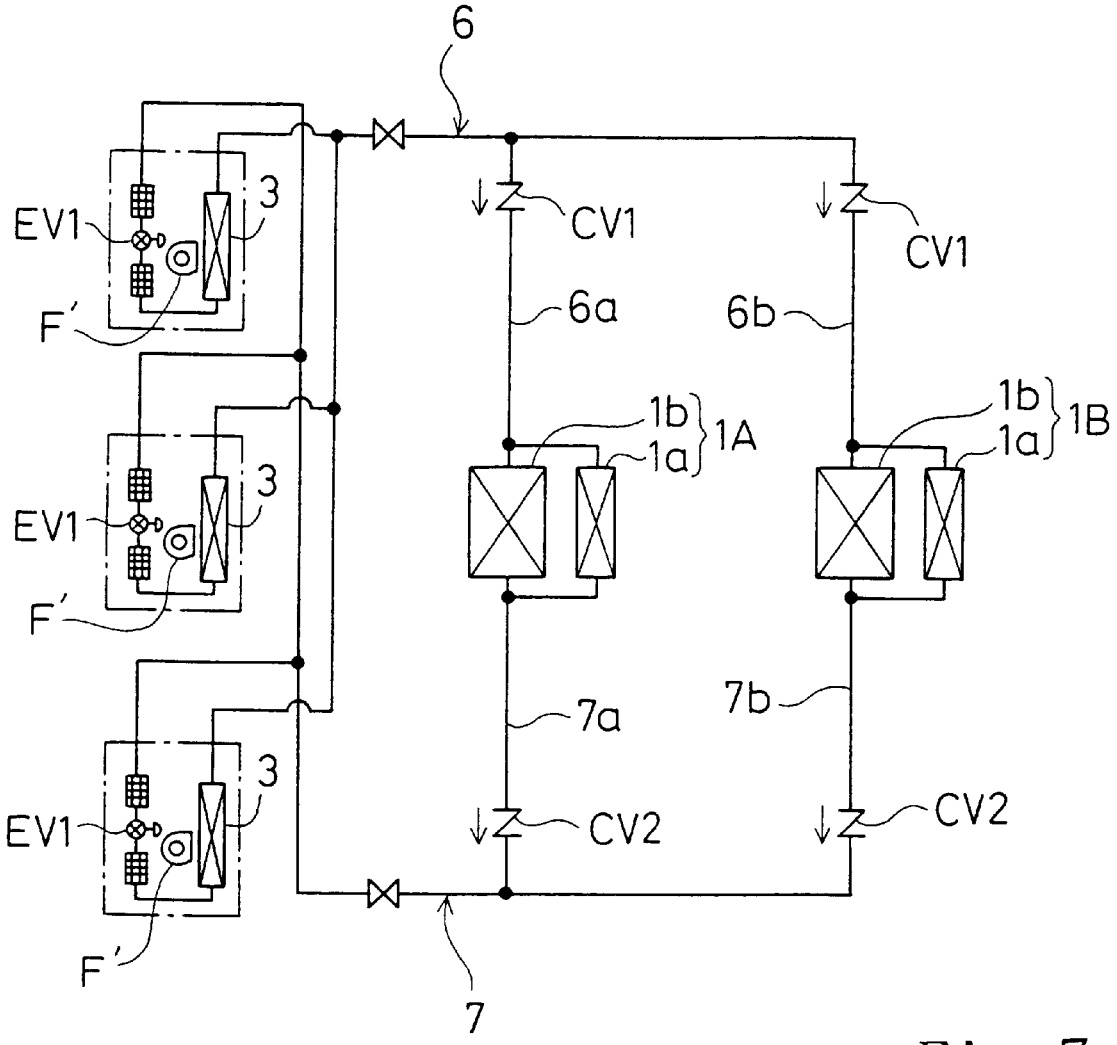
FIG. 7 is a diagram showing the entire secondary refrigerant circuit in the seventh embodiment.

FIG. 7 shows circuitry in which such a secondary refrigerant circuit (B) is applied to a so-called multi-machine provided with a plurality of indoor heat exchangers (3). In FIG. 7, (F') denotes an indoor fan.

In the seventh embodiment, each of the heat exchangers (1A, 1B) on the secondary heat source side is constituted by two (first and second) primary heat exchangers (1*a*, 1*b*). Alternatively, the heat exchanger (1A, 1B) may be constituted by a single heat exchanger.

(Eighth Embodiment)

The secondary refrigerant circuit (B) of this embodiment is provided with a plurality of (two, in this embodiment) the heat exchangers (1) on the secondary heat source side, each of which includes a pair of heat exchangers (1*a*, 1*b*), in the same way as in the seventh embodiment described above, thereby constituting a secondary refrigerant circuit (B) for an air conditioning system exclusively used for heating. It is noted that only the difference from the circuitry of the seventh embodiment will be described hereinafter.

Figure 8:
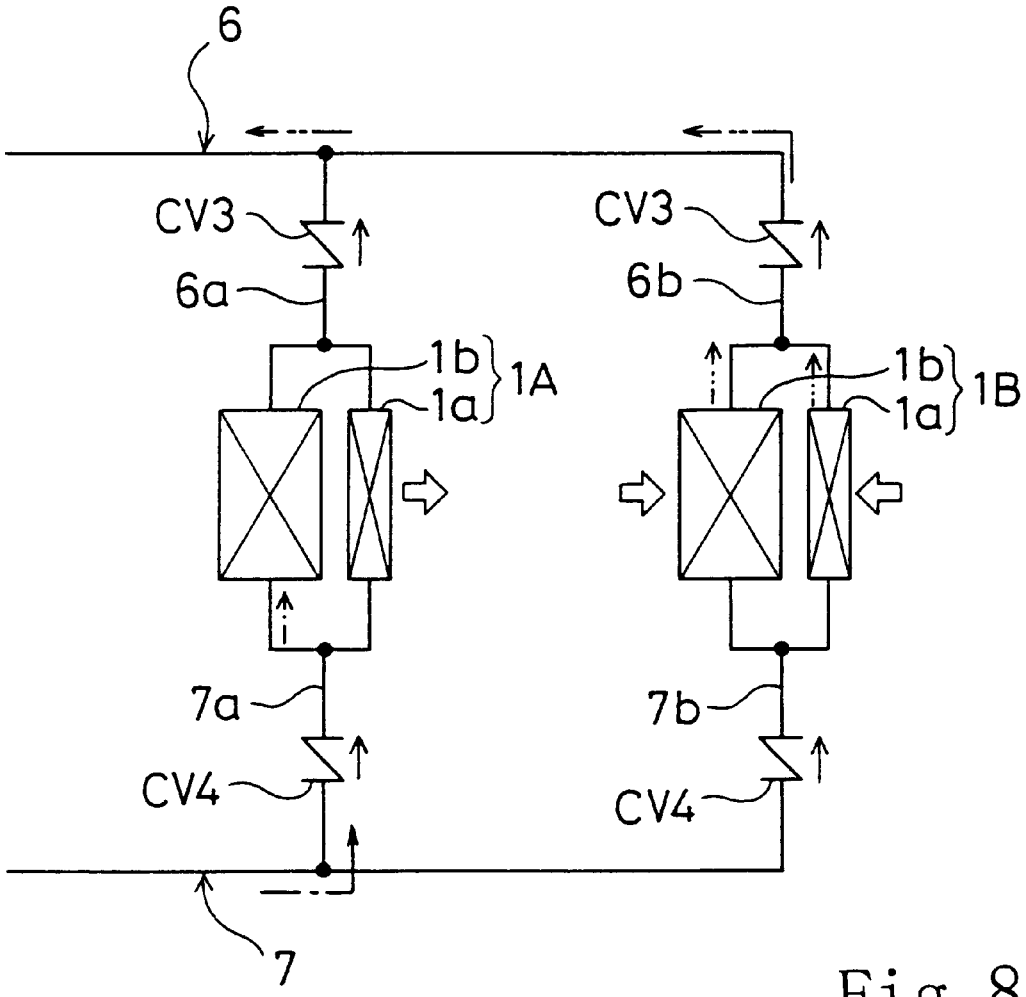
FIG. 8 is a diagram corresponding to FIG. 6 in the eighth embodiment.

As shown in FIG. 8, check valves (CV3, CV3) allowing only the gaseous refrigerant to flow from the respective heat exchangers (1A, 1B) on the secondary heat source side to the indoor heat exchanger (3) are provided for the respective branch pipes (6*a*, 6*b*) of the gas pipe (6). Check valves (CV4, CV4) allowing only the liquid refrigerant to flow from the indoor heat exchanger (3) to the respective heat exchangers (1A, 1B) on the secondary heat source side are provided for the respective branch pipes (7*a*, 7*b*) of the liquid pipe (7).

Next, the refrigerant circulation operation in the secondary refrigerant circuit (B) during the heating running will be described.

In the same way as in the seventh embodiment described above, switching is performed in the primary refrigerant circuit (A) such that while heat radiation running is being performed in one heat exchanger (1A) on the secondary heat source side, heat absorption running is performed in the other heat exchanger (1B) on the secondary heat source side. As a result, the heat-radiation state and the heat-absorption state are alternately and repeatedly established for both the heat exchangers (1A, 1B) on the secondary heat source side, whereby the refrigerant circulation operation is performed continuously.

Specifically, for example, the first heat exchanger (1*a*) on the secondary heat source side of the heat exchanger (1A) on the secondary heat source side, located on the left-hand side in FIG. 8, falls into the heat-radiation state and the low pressure is applied onto the second heat exchanger (1*b*) on the secondary heat source side, thereby recovering the liquid refrigerant from the indoor heat exchanger (3) (see the one-dot-chain arrows in FIG. 6). In the meantime, the heat exchanger (1B) on the secondary heat source side, located on the right-hand side, falls into the heat-absorption state, thereby supplying the gaseous refrigerant to the indoor heat exchanger (3) (see the two-dot-chain arrows in FIG. 6).

Thereafter, the heat-radiation state and the heat-absorption state are alternately and repeatedly established whereby the indoor air is cooled continuously and the air conditioning performance can be improved.

Figure 9:
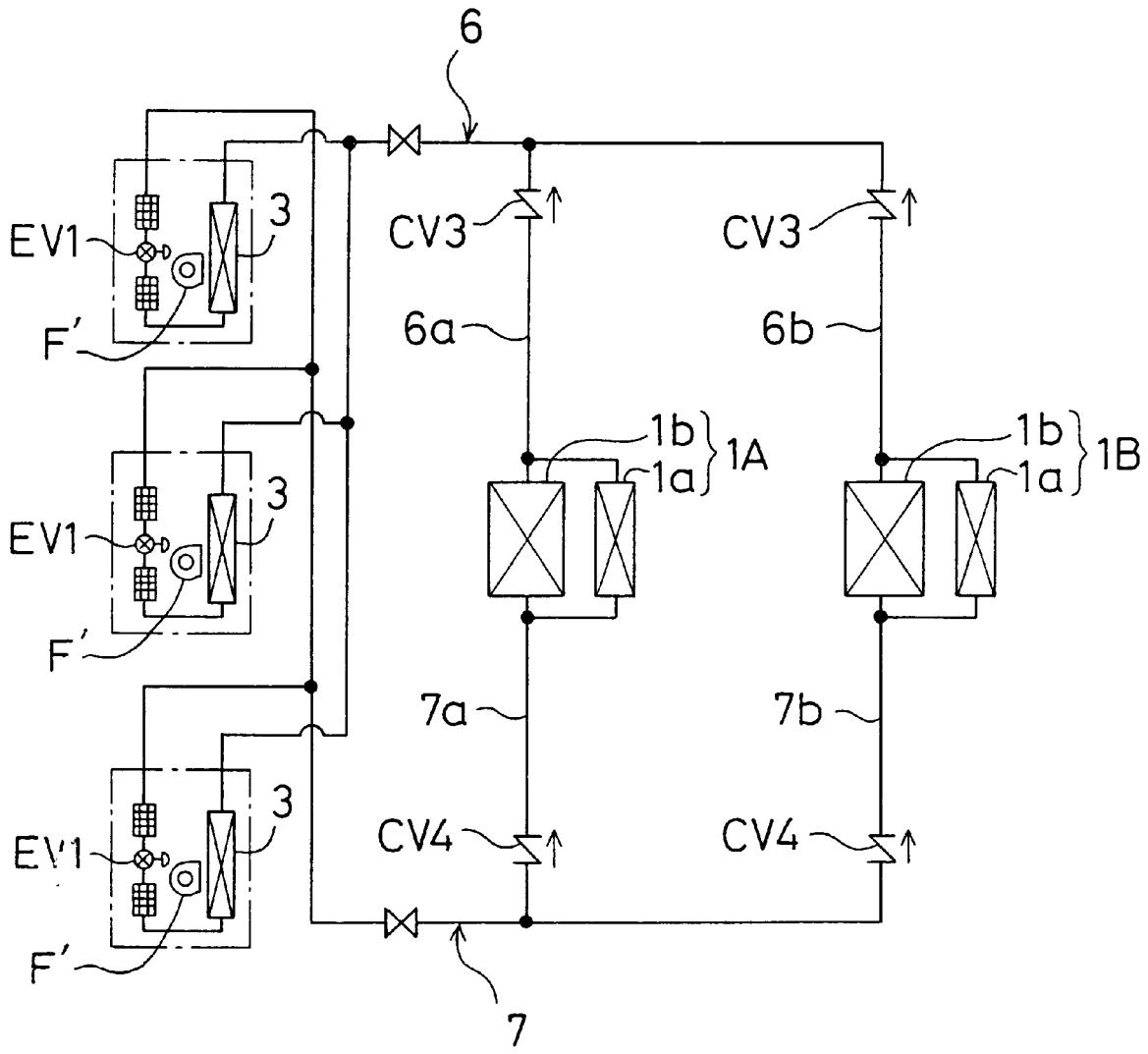
FIG. 9 is a diagram corresponding to FIG. 7 in the eighth embodiment.

FIG. 9 shows circuitry in which such a secondary refrigerant circuit (B) is applied to a so-called multi-system provided with a plurality of indoor heat exchangers (3).

In the eighth embodiment, each of the heat exchangers (1A, 1B) on the secondary heat source side is also constituted by two (first and second) primary heat exchangers (1*a*, 1*b*). Alternatively, the heat exchanger (1A, 1B) may be constituted by a single heat exchanger.

(Ninth Embodiment)

Figure 10:
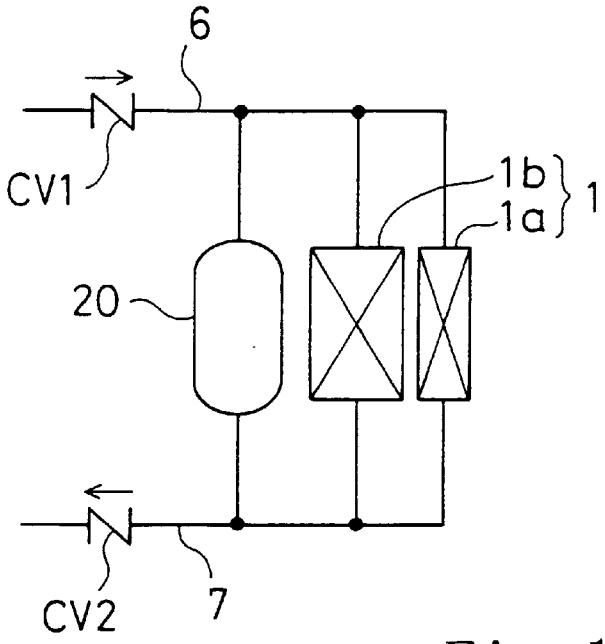
FIG. 10 is a diagram corresponding to FIG. 6 in the ninth embodiment.

As shown in FIG. 10, the secondary refrigerant circuit (B) of this embodiment includes a receiver (20) that is connected in parallel to the heat exchangers (1*a*, 1*b*) on the secondary heat source side in the secondary refrigerant circuit (B) exclusively used for cooling as described in the fifth embodiment.

In such a circuit, when the respective heat exchangers (1*a*, 1*b*) on the heat source side fall into a heat-radiation state and recover the gaseous refrigerant from the indoor heat exchanger (3) to condense it, the condensed liquid refrigerant can be reserved in the receiver (20). As a result, the amounts of the liquid refrigerant reserved in the heat exchangers (1*a*, 1*b*) on the secondary heat source side can be reduced. This makes it possible to secure a large heat exchange area for them, thereby improving the heat exchange efficiency and the performance of the entire system.

Figure 11:
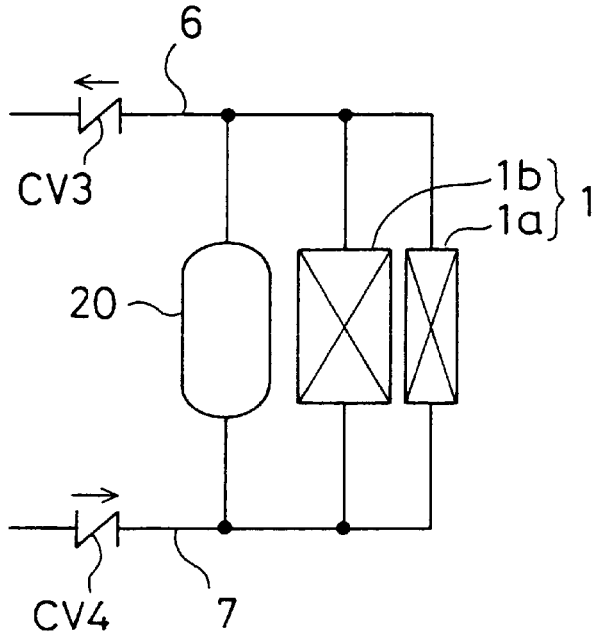
FIG. 11 is a diagram corresponding to FIG. 6 in a variant of the ninth embodiment.

It is noted that in FIG. 11, a similar receiver (20) is provided for the secondary refrigerant circuit (B) exclusively used for heating as described in the sixth embodiment. In such an arrangement, when the respective heat exchangers (1*a*, 1*b*) on the heat source side fall into a heat-absorption state and recover the liquid refrigerant from the indoor heat exchanger (3), the liquid refrigerant can also be reserved in the receiver (20). This also makes it possible to secure a large heat exchange area for them, thereby improving the performance of the entire system.

(Tenth Embodiment)

In this embodiment, the secondary refrigerant circuit (B) including a plurality of heat exchangers (1A, 1B) on the secondary heat source side as described in the seventh and the eighth embodiments is modified as a so-called heat pump circuit which can cool and heat the indoor air. It is noted that only the difference from the refrigerant circuits described in the seventh and the eighth embodiments will be described hereinafter.

Figure 12:
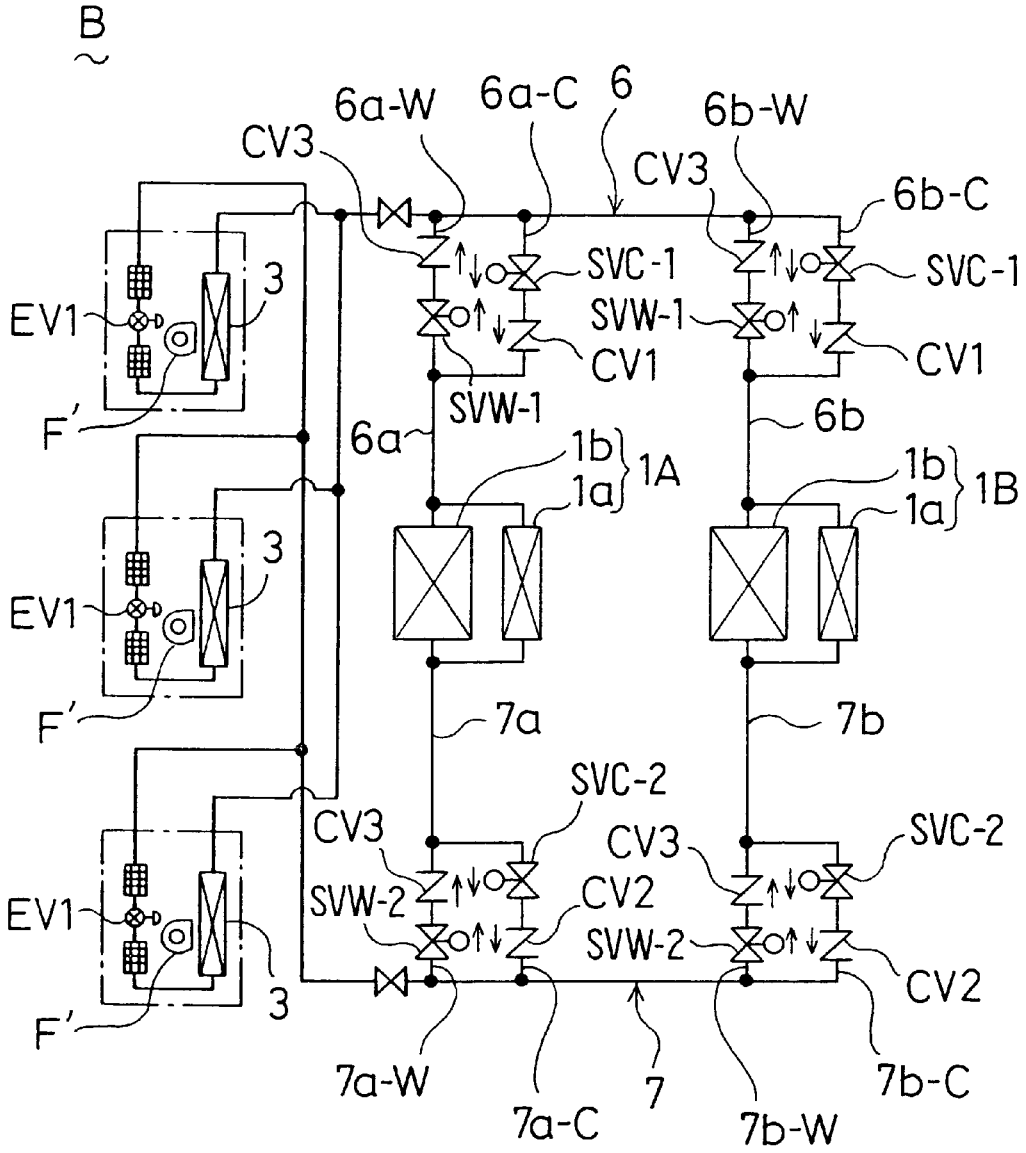
FIG. 12 is a diagram corresponding to FIG. 7 in the tenth embodiment.

As shown in FIG. 12, the branch pipes (6*a*, 6*b*) of the gas pipe (6) are branched into branch pipes for cooling (6*a*-C, 6*b*-C) and branch pipes for heating (6*a*-W, 6*b*-W), respectively. A check valve (CV1) allowing only the gaseous refrigerant to flow from the indoor heat exchanger (3) to the heat exchangers (1A, 1B) on the secondary heat source side and a solenoid valve (SVC-1) opening during the cooling running and closing during the heating running are provided for each of the branch pipes for cooling (6*a*-C, 6*b*-C). On the other hand, a check valve (CV3) allowing only the gaseous refrigerant to flow from the heat exchangers (1A, 1B) on the secondary heat source side to the indoor heat exchanger (3) and a solenoid valve (SVW-1) opening during the heating running and closing during the cooling running are provided for each of the branch pipes for heating (6*a*-W, 6*b*-W).

The branch pipes (7*a*, 7*b*) of the liquid pipe (7) are branched into branch pipes for cooling (7*a*-C, 7*b*-C) and branch pipes for heating (7*a*-W, 7*b*-W), respectively. A check valve (Cv2) allowing only the liquid refrigerant to flow from the heat exchangers (1A, 1B) on the secondary heat source side to the indoor heat exchanger (3) and a solenoid valve (SVC-2) opening during the cooling running and closing during the heating running are provided for each of the branch pipes for cooling (7*a*-C, 7*b*-C). On the other hand, a check valve (CV3) allowing only the liquid refrigerant to flow from the indoor heat exchanger (3) to the heat exchangers (1A, 1B) on the secondary heat source side and a solenoid valve (SVW-2) opening during the heating running and closing during the cooling running are provided for each of the branch pipes for heating (7*a*-W, 7*b*-W).

Next, the running operations thereof will be described.

During the cooling running, switching is performed between two states. One of the states is a state where the solenoid valve (SVC-1) coupled to the heat exchanger (1B) on the secondary heat source side located on the right-hand side and the solenoid valve (SVC-2) coupled to the heat exchanger (1A) on the secondary heat source side located on the left-hand side are opened and the other solenoid valves are closed.

The other state is a state where the solenoid valve (SVC2) coupled to the heat exchanger (1B) on the secondary heat source side located on the right-hand side and the solenoid valve (SVC-1) coupled to the heat exchanger (1A) on the secondary heat source side located on the left-hand side are opened and the other solenoid valves are closed.

These two states are alternately switched, thereby performing the refrigerant circulation operation and cooling the indoor air in the same way as in the seventh embodiment described above.

On the other hand, one of the states during the room heating running is a state where the solenoid valve (SVW-1) coupled to the heat exchanger (1B) on the secondary heat source side located on the right-hand side and the solenoid valve (SVW-2) coupled to the heat exchanger (1A) on the secondary heat source side located on the left-hand side are opened and the other solenoid valves are closed.

The other state is a state where the solenoid valve (SVW2) coupled to the heat exchanger (1B) on the secondary heat source side located on the right-hand side and the solenoid valve (SVW-1) coupled to the heat exchanger (1A) on the secondary heat source side located on the left-hand side are opened and the other solenoid valves are closed.

While alternately switching these two states, the refrigerant circulation operation is performed and the indoor air is heated in the same way as in the eighth embodiment described above.

As can be understood, in the refrigerant circuit of this embodiment, the room cooling running and heating running can be arbitrarily set by performing operations of switching the valves (SVC-1, SVC-2, SVW-1, SVW-2). As a result, a highly practical air conditioning system can be obtained.

In the tenth embodiment, each of the heat exchangers (1A, 1B) on the secondary heat source side is constituted by two (first and second) primary heat exchangers (1*a*, 1*b*). Alternatively, the heat exchanger (1A, 1B) may be constituted by a single heat exchanger.

(Eleventh Embodiment)

Next, the entire arrangement of specific circuitry obtained by combining the secondary refrigerant circuit (B) described in the tenth embodiment with the primary refrigerant circuit (A) will be described..

Figure 13:
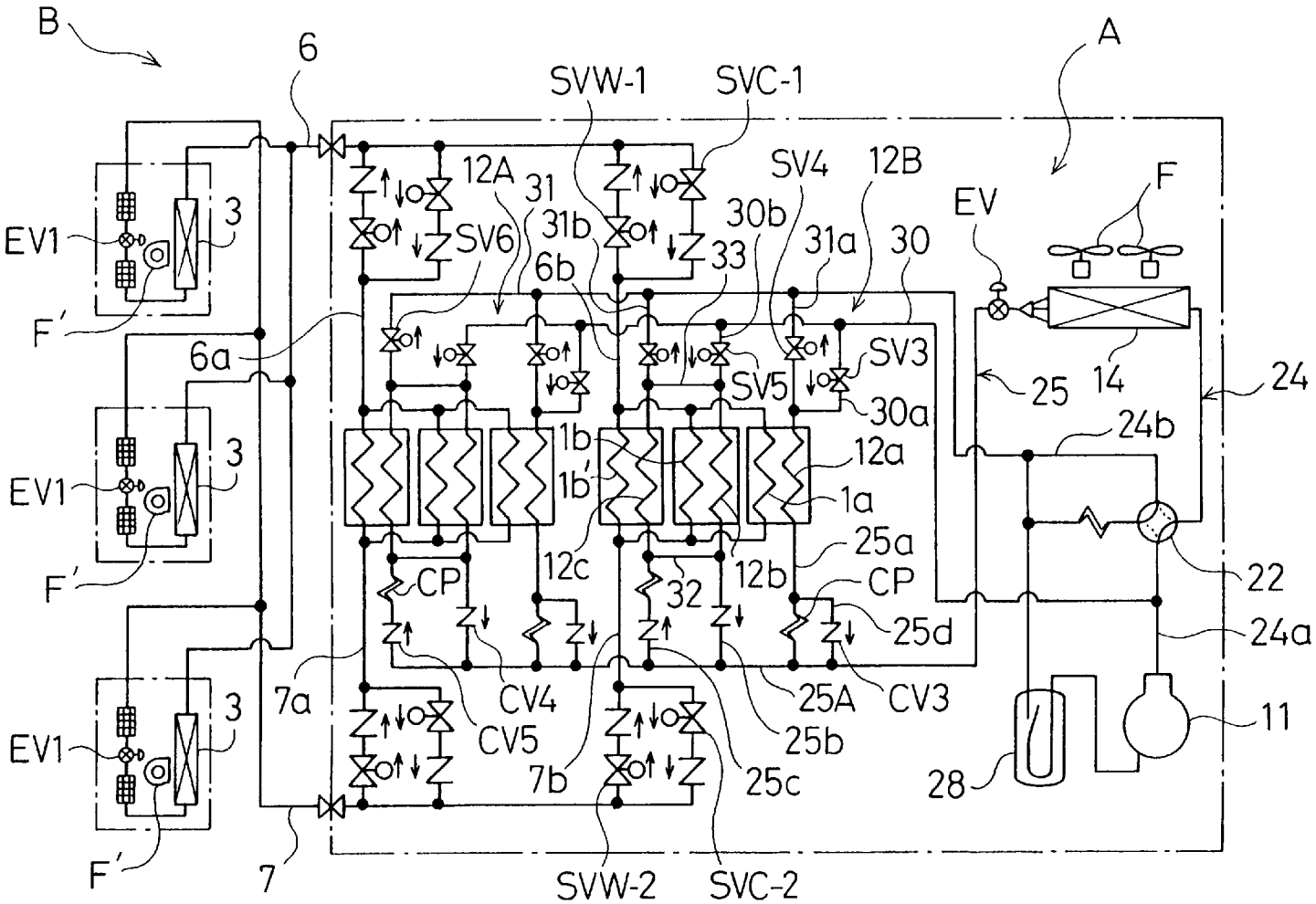
FIG. 13 is a diagram corresponding to FIG. 1 in the eleventh embodiment.

As shown in FIG. 13, in this embodiment, the primary refrigerant circuit (A) includes: a compressor (11); a four-position selector valve (22); an outdoor heat exchanger (14) provided with an outdoor fan (F) in the vicinity thereof; an outdoor electrically motorized expansion valve (EV); and heat exchangers (12A, 12B) on the primary heat source side, each of which is constituted by a plurality of heat exchangers. In the outdoor heat exchanger (14), a gas-side pipe (24) is connected to one end thereof on the gas-side and a liquid-side pipe (25) is connected to the other end thereof on the liquid side.

The gas-side pipe (24) is selectable between an outlet side and an inlet side of the compressor (11) by means of the four-position selector valve (22). That is to say, the gas-side pipe (24) includes: an outlet gas line (24*a*) connecting the outlet side of the compressor (11) to the four-position selector valve (22); and an inlet gas line (24*b*) connecting the inlet side of a compression mechanism (21) to the four-position selector valve (22). The inlet gas line (24*b*) is provided with an accumulator (28).

The liquid-side pipe (25) is provided with the outdoor electrically motorized expansion valve (EV). One end of the liquid-side pipe (25) is connected to the outdoor heat exchanger (14) and the other end thereof is branched into branch pipes, which are connected to the respective heat exchangers (12*a* to 12*c*) on the primary heat source side. The liquid-side pipe (25) includes a main liquid pipe (25A) and branched liquid pipes (25*a* to 25*c*) branched from the main liquid pipe (25). The respective branched liquid pipes (25*a* to 25*c*) are connected to the heat exchangers (12*a* to 12*c*), respectively.

The primary refrigerant circuit (A) further includes: an outlet line (30) for connecting the outlet side of the compressor (11) to the respective heat exchangers (12*a* to 12*c*) on the primary heat source side; and an inlet line (31) for recovering the gaseous refrigerant from the heat exchangers (12*a* to 12*c*) on the primary heat source side to the inlet side of the compressor (11).

Furthermore, of the six heat exchangers (12*a* to 12*c*) on the primary heat source side, the three heat exchangers (12*a* to 12*c*) located on the left-hand side in FIG. 13 constitute the first heat exchanger (12A) on the primary heat source side for exchanging heat with the heat exchanger (1A) on the secondary heat source side located on the left-hand side in the tenth embodiment described above (see FIG. 12). The three heat exchangers (12*a* to 12*c*) on the right-hand side constitute the second heat exchanger (12B) on the primary heat source side for exchanging heat with the heat exchanger (1B) on the secondary heat source side located on the right-hand side in the tenth embodiment.

Since the arrangements of the respective heat exchangers (12A, 12B) on the primary heat source side are substantially the same, the connection states of the respective pipes (25*a* to 25*c*, 30, 31) with respect to one heat exchanger (12A) on the secondary heat source side will be described hereinafter. Also, these heat exchangers will be herein referred to as a first, a second and a third heat exchanger (12*a* to 12*c*) from the right for convenience.

The first heat exchanger (12*a*) is connected at the lower end to the first branched liquid pipe (25*a*) that is branched from the main liquid pipe (25A) and that includes a capillary tube (CP). One end of the first liquid pipe (25*d*) is connected between the capillary tube (CP) of the first branched liquid pipe (25*a*) and the first heat exchanger (12*a*). The first liquid pipe (25*d*) is connected at the other end to the main liquid pipe (25A) and includes a check valve (CV3) allowing only the liquid refrigerant to flow from the first heat exchanger (12*a*) to the main liquid pipe (25A). The upper end of the first heat exchanger (12*a*) is connected to the outlet line (30) through the first gas pipe (30*a*) and to the inlet line (31) through the second gas pipe (31*a*), respectively. Solenoid valves (SV3, SV4) are provided for the gas pipes (30*a*, 31*a*), respectively.

The second heat exchanger (12*b*) is connected at the lower end to the second branched liquid pipe (25*b*) that is branched from the main liquid pipe (25A) and that includes a check valve (CV4) allowing only the liquid refrigerant to flow from the second heat exchanger (12*b*) to the main liquid pipe (25A). The upper end of the second heat exchanger (12*b*) is connected to the outlet line (30) through the third gas pipe (30*b*). A solenoid valve (SV5) is provided for the third gas pipe (30*b*).

The third heat exchanger (12*c*) is connected at the lower end to the third branched liquid pipe (25*c*) that is branched from the main liquid pipe (25A) and that includes a check valve (CV5) allowing only the liquid refrigerant to flow from the main liquid pipe (25A) to the third heat exchanger (12*c*) and a capillary tube (CP). The upper end of the third heat exchanger (12*c*) is connected to the inlet line (31) through the fourth gas pipe (31*b*). A solenoid valve (SV6) is also provided for the fourth gas pipe (31*b*).

In the second branched liquid pipe (25b), one end of a first connecting pipe (32) is connected between the second heat exchanger (12*b*) and the check valve (CV4). The other end of the first connecting pipe (32) is connected between the third heat exchanger (12*c*) and the capillary tube (CP) in the third branched liquid pipe (25*c*). In the third gas pipe (30b), one end of a second connecting pipe (33) is connected between the second heat exchanger (12*b*) and the solenoid valve (SV5). The other end of the second connecting pipe (33) is connected between the third heat exchanger (12*c*) and the solenoid valve (SV6) in the fourth gas pipe (31*b*).

On the other hand, the secondary refrigerant circuit (B) is the same as that described in the tenth embodiment. Of the pair of heat exchangers (1*a*, 1*b*) of the tenth embodiment, the smaller one on the right-hand side or the first heat exchanger (1*a*) on the secondary heat source side is disposed adjacent to the first heat exchanger (12*a*) and exchanges heat therewith. On the other hand, the larger one on the left-hand side or the heat exchanger (1*b*) is constituted by a pair of (second and third) heat exchangers (1*b*, 1*b*') on the secondary heat source side, which are connected in parallel to each other and are disposed adjacent to the second and the third heat exchangers (12*b*, 12*c*), respectively, thereby exchanging heat therewith. That is to say, these heat exchangers (1*a*, 1*b*, 1*b*') are connected in parallel to each other. The upper ends thereof are connected to the branch pipes (6*a*, 6*b*) of the gas pipe (6) and the lower ends thereof are connected to the branch pipes (7*a*, 7*b*) of the liquid pipe (7).

Next, the air conditioning running thereof will be described. First, the cooling running thereof will be described with reference to FIGS. 14 and 15.

When the cooling running is started, the first cooling running state is established. Specifically, in the primary refrigerant circuit (A), the four-position selector valve (22) is switched to the direction indicated by the solid lines, the solenoid valve (SV3) of the first gas pipe (30*a*) for the second heat exchanger (12B) on the primary heat source side, the solenoid valve (SV4) of the second gas pipe (31*a*) for the first heat exchanger (12A) on the primary heat source side and the solenoid valve (SV6) and the electrically motorized expansion valve (EV) of the third gas pipe (31*b*) are opened, and the other solenoid valves are closed. On the other hand, in the secondary refrigerant circuit (B), the solenoid valve (SVC-1) coupled to the heat exchanger (1A) on the secondary heat source side located on the left-hand side and the solenoid valve (SVC-2) coupled to the heat exchanger (1B) on the secondary heat source side located on the right-hand side are opened and the other solenoid valves are closed.

Figure 14:
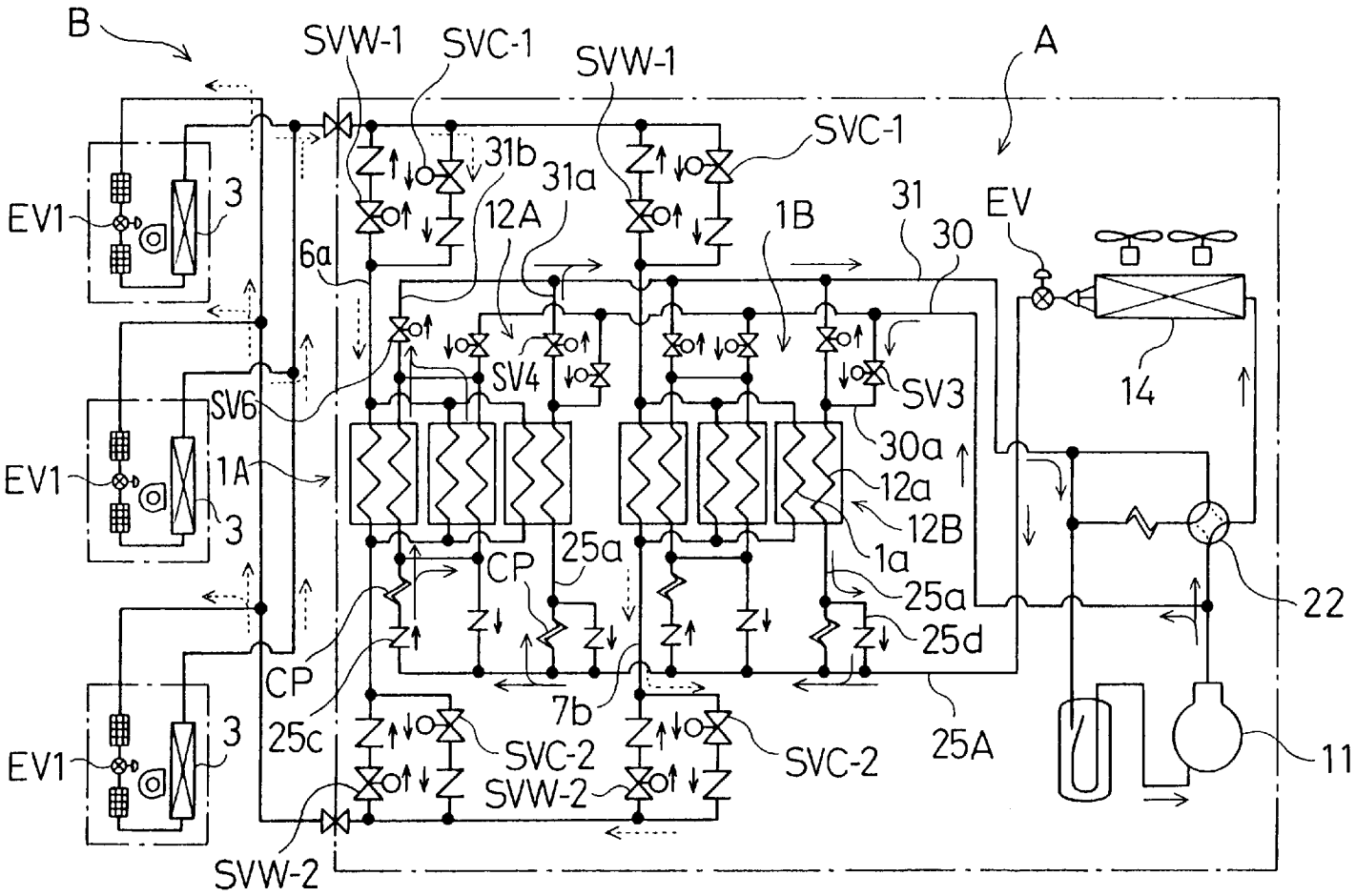
FIG. 14 is a diagram showing a first cooling running condition in the eleventh embodiment.
Figure 15:
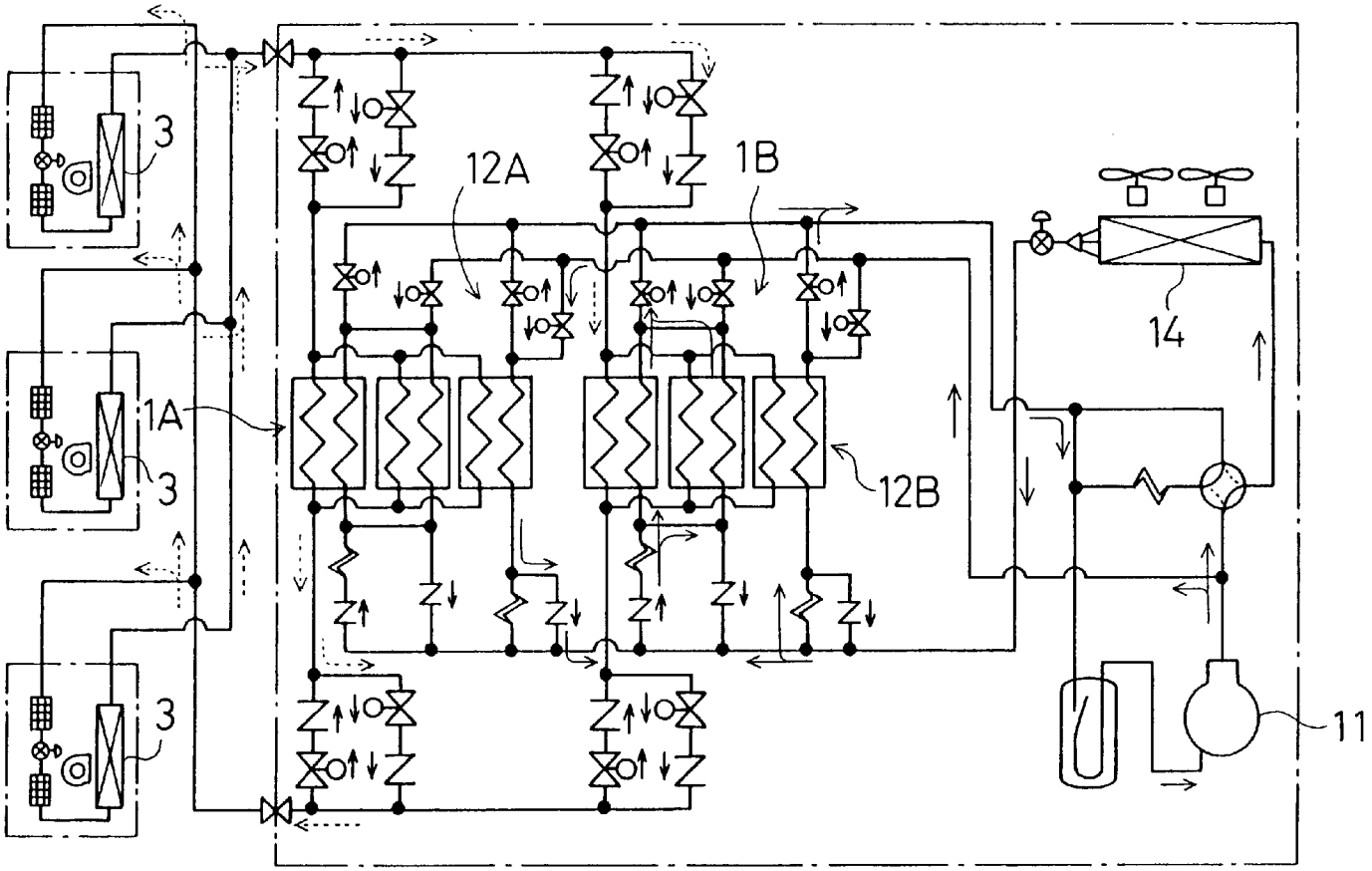
FIG. 15 is a diagram showing a second cooling running condition in the eleventh embodiment.

If the compressor (11) is driven in such a state, a part of the refrigerant discharged from the compressor (11) is condensed in the outdoor heat exchanger (14) in the primary refrigerant circuit (A) as indicated by the solid-line arrows in FIG. 14. The pressure of the refrigerant is reduced in the capillary tubes (CP) of the first and the third branched liquid pipes (25*a*, 25*c*) coupled to the first heat exchanger (12A) on the primary heat source side. And the refrigerant flows in the respective heat exchangers (12*a*, 12*b*, 12*c*) of the first heat exchanger (12A) on the primary heat source side. The liquid refrigerant exchanges heat with the respective heat exchangers (1*a*, 1*b*, 1*b*') of the first heat exchanger (1A) on the secondary heat source side. The liquid refrigerant extracts heat from the refrigerants in the respective heat exchangers (1*a*, 1*b*, 1*b*') and is evaporated. Thereafter, the refrigerant returns through the inlet line (31) to the compressor (11).

The other part of the refrigerant discharged from the compressor (11) flows through the outlet line (30) into the first heat exchanger (12*a*) of the second heat exchanger (12B) on the primary heat source side. The refrigerant exchanges heat with the first heat exchanger (1*a*) of the second heat exchanger (1B) on the secondary heat source side. The refrigerant applies heat to the refrigerant in the heat exchanger (1*a*) and is condensed. Thereafter, the refrigerant flows through the first branched liquid pipe (25*a*) and the first liquid pipe (25*d*), joins the liquid refrigerant in the main liquid pipe (25A) and then flows through the first heat exchanger (12A) on the primary heat source side.

On the other hand, in the secondary refrigerant circuit (B), condensation of a refrigerant (heat radiation operation) is caused in the first heat exchanger (1A) on the secondary heat source side and evaporation of a refrigerant (heat absorption operation) is caused in the first heat exchanger (1*a*) of the second heat exchanger (1B) on the secondary heat source side. Thus, the internal pressure of the first heat exchanger (1*a*) of the second heat exchanger (1B) on the secondary heat source side rises. The pressure is applied onto the second and the third heat exchangers (1*b*, 1*b*') of the second heat exchanger (1B) on the secondary heat source side. As indicated by the broken-line arrows in FIG. 14, the liquid refrigerant is supplied from these heat exchangers (1*a*, 1*b*, 1*b*') through the branch pipe (7*b*) of the liquid pipe (7) into the indoor heat exchanger (3). The pressure of the liquid refrigerant is reduced in the indoor electrically motorized expansion valve (EV1). After the liquid refrigerant is evaporated in the indoor heat exchanger (3), the liquid refrigerant is passed through the branch pipe (6*a*) of the gas pipe (6) and then recovered into the respective heat exchangers (1*a*, 1*b*, 1*b*') of the first heat exchanger (1A) on the secondary heat source side. The gaseous refrigerant recovered into the respective heat exchangers (1*a*, 1*b*, 1*b*') exchanges heat with the respective heat exchangers (12*a*, 12*b*, 12*c*) of the first heat exchanger (12A) on the primary heat source side. And the refrigerant is condensed and reserved as a liquid refrigerant.

After such an operation has been performed, the switching operations are performed in the respective refrigerant circuits (A, B) to establish a second cooling running state, and heat radiation and heat absorption operations are interchanged between the respective heat exchangers (1A, 1B) on the secondary heat source side. As indicated by the solid-line and broken-line arrows in FIG. 15, the refrigerant that has flowed from the second heat exchanger (1B) on the secondary heat source side to the indoor heat exchanger (3) is recovered into the first heat exchanger (1A) on the secondary heat source side, whereby a refrigerant circulation operation is performed.

Next, the room heating running thereof will be described.

When the heating running is started, the first heating running state is firstly established. Specifically, in the primary refrigerant circuit (A), the solenoid valve (SV3) of the first gas pipe (30*a*) and the solenoid valve (SV5) of the third gas pipe (30*b*) for the first heat exchanger (12A) on the primary heat source side and the solenoid valve (SV4) of the second gas pipe (31*a*) for the second heat exchanger (12B) on the heat source side are opened, and the other solenoid valves are closed. On the other hand, in the secondary refrigerant circuit (B), the solenoid valve (SVW-1) coupled to the heat exchanger (1A) on the secondary heat source side located on the left-hand side and the solenoid valve (SVW-2) coupled to the heat exchanger (1B) on the secondary heat source side located on the right-hand side are opened and the other solenoid valves are closed.

Figure 16:
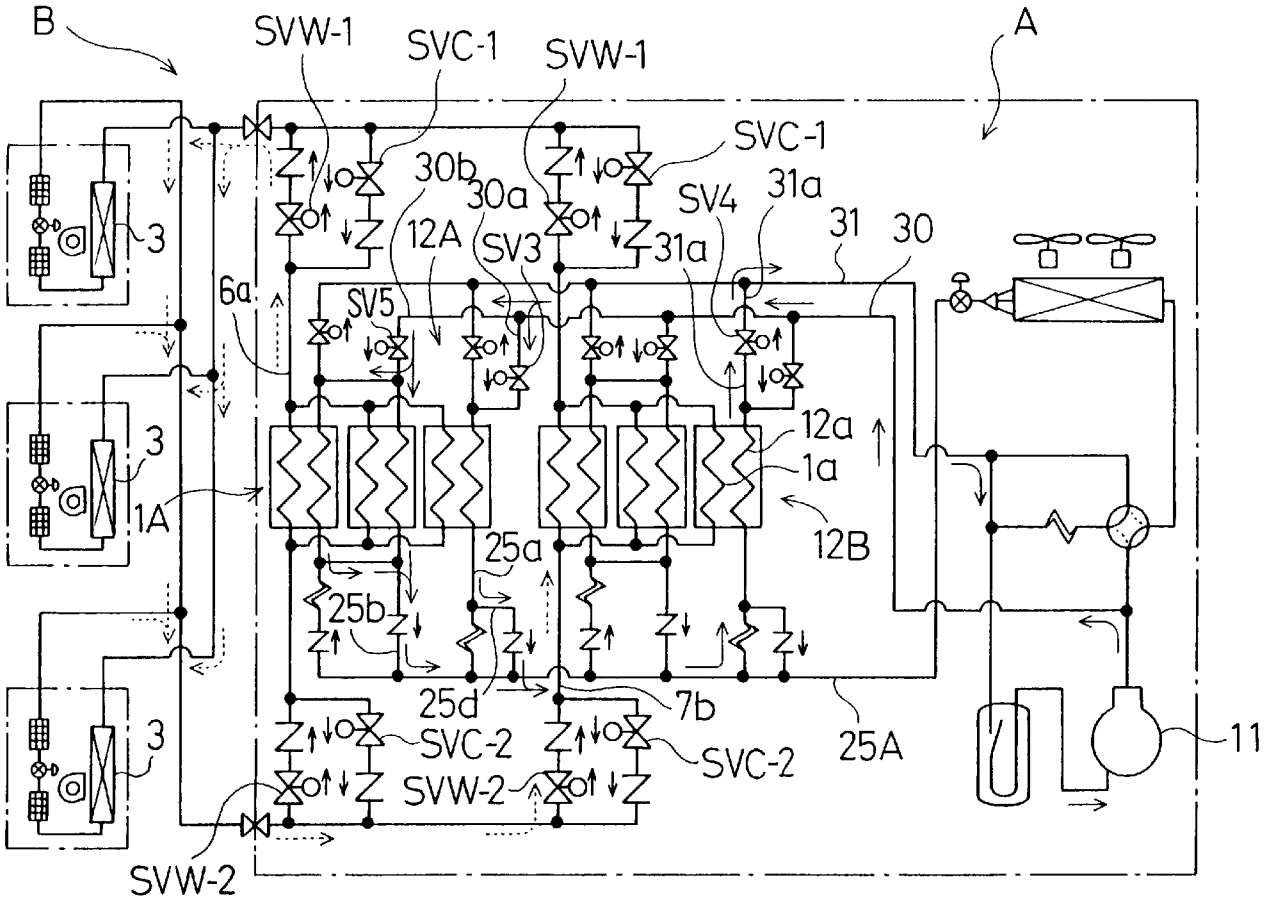
FIG. 16 is a diagram showing a first heating running condition in the eleventh embodiment.

If the compressor (11) is driven in such a state, the refrigerant discharged from the compressor (11) flows through the outlet line (30) into the respective heat exchangers (12*a* to 12*c*) of the first heat exchanger (12A) on the primary heat source side in the primary refrigerant circuit (A) as indicated by the solid-line arrows in FIG. 16. The refrigerant exchanges heat with the respective heat exchangers (1*a*, 1*b*, 1*b*') of the first heat exchanger (12A) on the secondary heat source side. The refrigerant applies heat to the refrigerants in these heat exchangers (1*a*, 1*b*, 1*b*') and is condensed. Thereafter, the refrigerant in the first heat exchanger (1*a*) flows through the first branched liquid pipe (25*a*) and the first liquid pipe (25*d*) into the main liquid pipe (25A) and the refrigerants in the second and the third heat exchangers (1*b*, 1*b*') flow through the second branched liquid pipe (25*b*) into the main liquid pipe (25A). The liquid refrigerant that has flowed through the main liquid pipe (25A) flows through the first heat exchanger (12*a*) of the second heat exchanger (12B) on the primary heat source side. The liquid refrigerant exchanges heat with the first heat exchanger (1*a*) of the second heat exchanger (1B) on the secondary heat source side. The liquid refrigerant extracts heat from the refrigerant in the heat exchanger (1*a*) and is evaporated. Thereafter, the refrigerant returns through the second gas pipe (31*a*) and the inlet line (31) to the compressor (11).

On the other hand, in the secondary refrigerant circuit (B), evaporation of a refrigerant (heat absorption operation) is caused in the first heat exchanger (1A) on the secondary heat source side and condensation of a refrigerant (heat radiation operation) is caused in the first heat exchanger (1*a*) of the second heat exchanger (1B) on the secondary heat source side. Thus, the internal pressures of the respective heat exchangers (1*a*, 1*b*, 1*b*') of the first heat exchanger (1A) on the secondary heat source side rise. As a result, the gaseous refrigerant is supplied from the respective heat exchangers (1*a*, 1*b*, 1*b*') through the branch pipe (6*a*) of the gas pipe (6) into the indoor heat exchanger (3) and condensed in the indoor heat exchanger (3). Thereafter, the refrigerant is passed through the branch pipe (7*b*) of the liquid pipe (7) and then recovered into the respective heat exchangers (1*a*, 1*b*, 1*b*') of the second heat exchanger (1B) on the secondary heat source side.

Figure 17:
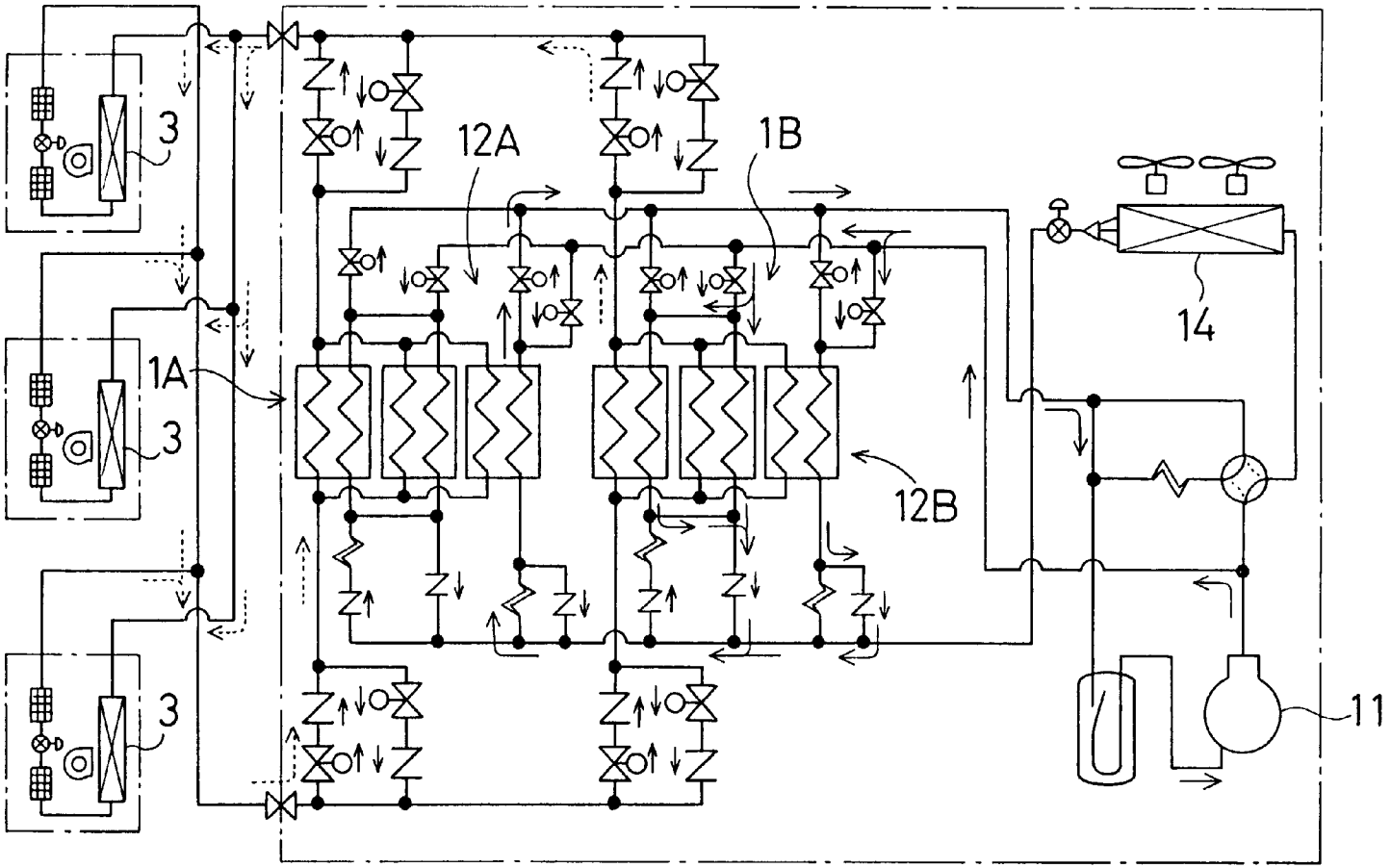
FIG. 17 is a diagram showing a second heating running condition in the eleventh embodiment.

After such an operation has been performed, the switching operations are performed in the respective refrigerant circuits (A, B) to establish a second heating running state, and heat radiation and heat absorption operations are interchanged between the respective heat exchangers (1A, 1B) on the secondary heat source side. As indicated by the solid-line and broken-line arrows in FIG. 17, the refrigerant that has been introduced from the second heat exchanger (1B) on the secondary heat source side to the indoor heat exchanger (3) is recovered into the first heat exchanger (1A) on the secondary heat source side, whereby a refrigerant circulation operation is performed.

As described above, in this embodiment, since the room cooling running and heating running can be arbitrarily set and the continuous running thereof can be performed, a highly practical air conditioning system can be obtained.

(Twelfth Embodiment)

This embodiment constitutes a secondary refrigerant circuit (B) for a multi-air conditioning system of a so-called "free cooling/heating" type including a plurality of indoor heat exchangers (3, 3, . . . ), which are individually disposed in a plurality of rooms and which can individually select cooling running or heating running. It is noted that only the difference from the refrigerant circuit (see FIG. 12) as described in the tenth embodiment will be described hereinafter.

Figure 18:
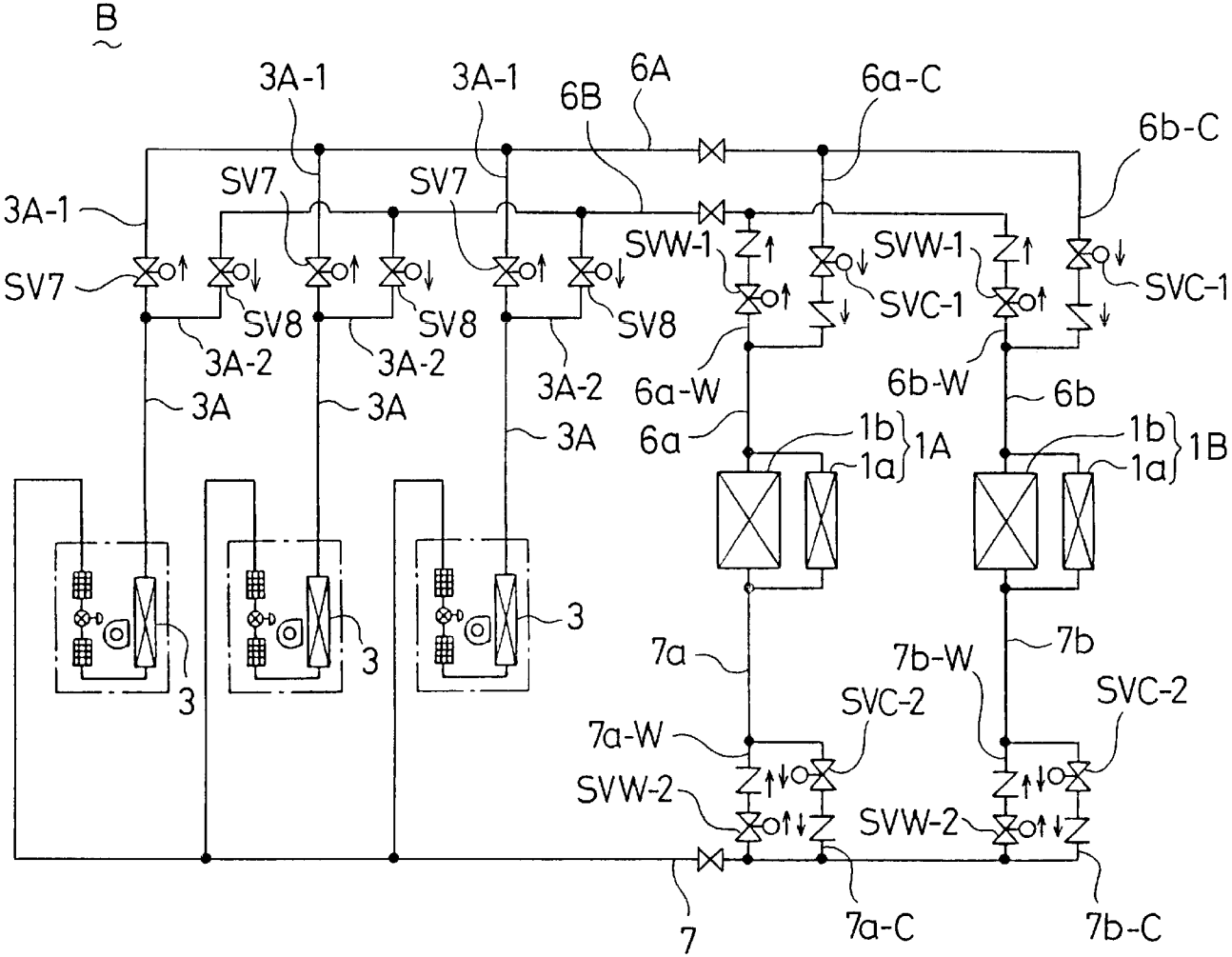
FIG. 18 is a diagram corresponding to FIG. 7 in the twelfth embodiment.

As shown in FIG. 18, the secondary refrigerant circuit (B) includes two (first and second) gas pipes (6A, 6B). Branch pipes (6*a*-C, 6*b*-C) for cooling are connected to the first gas pipe (6A) and branch pipes (6*a*-W, 6*b*-W) for heating are connected to the second gas pipe (6B). The gas-side pipe (3A) of each of the indoor heat exchangers (3, 3, . . . ) is branched into a first connection pipe (3A-1) and a second connection pipe (3A-2). The first connection pipe (3A-1) and the second connection pipe (3A-2) are connected to the first gas pipe (6A) and the second gas pipe (6B), respectively. Solenoid valves (SV7, SV8) are provided for the respective connection pipes (3A-1, 3A-2). The other arrangement is the same as that of the tenth embodiment described above.

Next, the air conditioning running operation will be described.

First, if the entire heat balance of the respective indoor heat exchangers (3, 3, . . . ) indicates a cooling request for example, if the number of indoor heat exchangers performing cooling running is larger than the number of indoor heat exchangers performing heating running), the following two states are selectable.

One of the states is a state where the solenoid valve (SVC-1) coupled to the heat exchanger (1A) on the secondary eat source side located on the left-hand side and the solenoid valve (SVC-2) coupled to the heat exchanger (1B) on the secondary heat source side located on the right-hand side are opened and the other solenoid valves are closed.

The other state is a state where the solenoid valve (SVC2) coupled to the heat exchanger (1A) on the secondary heat source side located on the left-hand side and the solenoid valve (SVC-1) coupled to the heat exchanger (1B) on the secondary heat source side located on the right-hand side are opened and the other solenoid valves are closed. These two states are alternately selected.

On the other hand, if the entire heat balance of the respective indoor heat exchangers (3, 3, . . . ) indicates a heating request (for example, if the number of indoor heat exchangers performing heating running is larger than the number of indoor heat exchangers performing cooling running), the following two states are selectable.

One of the states is a state where the solenoid valve (SVW-1) coupled to the heat exchanger (1A) on the secondary heat source side located on the left-hand side and the solenoid valve (SVW-2) coupled to the heat exchanger (1B) on the secondary heat source side located on the right-hand side are opened and the other solenoid valves are closed.

The other state is a state where the solenoid valve (SVW-2) coupled to the heat exchanger (1A) on the secondary heat source side located on the left-hand side and the solenoid valve (SVW-1) coupled to the heat exchanger (1B) on the secondary heat source side located on the right-hand side are opened and the other solenoid valves are closed. These two states are alternately selected.

Moreover, the opening/closing states of the solenoid valves (SV7, SV8) provided for the first connection pipe (3A-1) and the second connection pipe (3A-2) are selected such that the solenoid valve (SV7) of the first connection pipe (3A-1) connected to an indoor heat exchanger (3) performing cooling running is opened and the solenoid valve (SV8) of the second connection pipe (3A-2) is closed. On the other hand, the solenoid valve (SV8) of the second connection pipe (3A-2) connected to an indoor heat exchanger (3) performing heating running is opened and the solenoid valve (SV7) of the first connection pipe (3A-1) is closed.

In such a state, the liquid refrigerant is supplied through the liquid pipe (7) to the indoor heat exchanger (3) performing cooling running. On the other hand, the liquid refrigerating is supplied from the second gas pipe (6B) through the second connection pipe (3A-2) to the indoor heat exchanger (3) performing heating running. As a result, the respective indoor heat exchangers (3, 3, . . . ) individually perform cooling running and heating running.

(Variants of Primary Refrigerant Circuit)

In the following thirteenth and fourteenth embodiments, variants of the primary refrigerant circuit (A) to be combined 10 with the above-described secondary refrigerant circuit (B) will be described.

(Thirteenth Embodiment)

The primary refrigerant circuit (B) of this embodiment is a variant of the primary refrigerant circuit (A) to be combined with the secondary refrigerant circuit (B) of the above-described first embodiment, and is constituted as a heat pump circuit.

Figure 19:
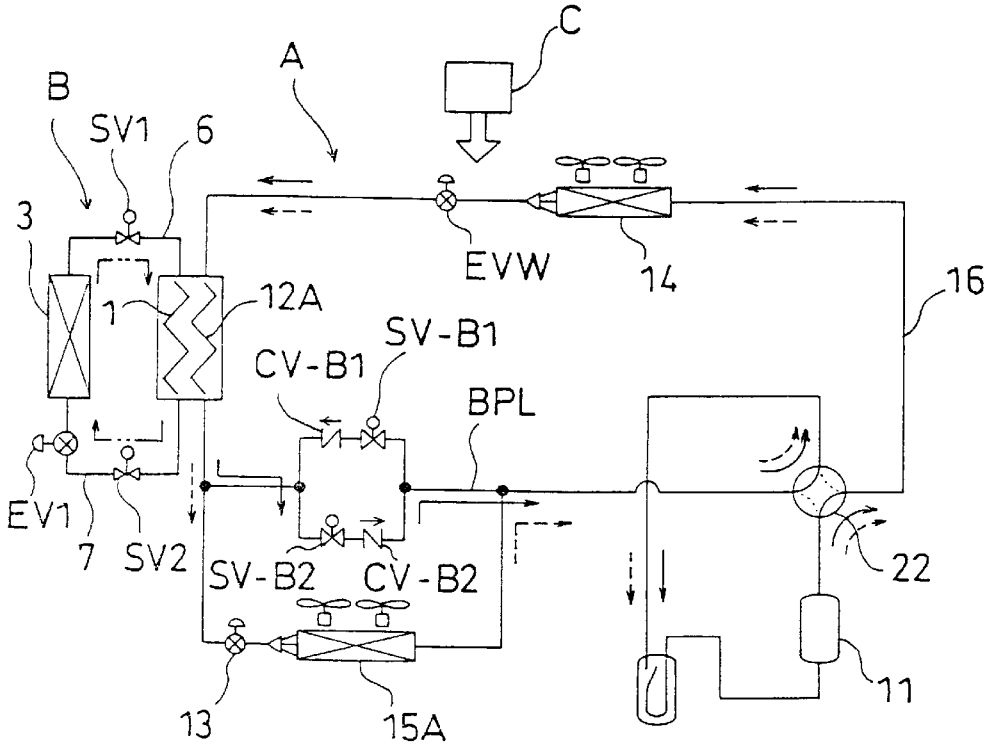
FIG. 19 is a diagram corresponding to FIG. 1 and showing a cooling running condition in the thirteenth embodiment.

As shown in FIG. 19, the primary refrigerant circuit (A) of this embodiment is constructed by connecting a compressor (11), a four-position selector valve (22), an outdoor heat exchanger (14), a first electrically motorized expansion valve (EVW), a heat exchanger (12A) on the primary heat source side, a second electrically motorized expansion valve (13) and an auxiliary heat exchanger (15A) to each other through a refrigerant pipe (16). A by-pass line (BPL) by-passing the auxiliary heat exchanger (15A) is provided between the heat exchanger (12A) on the primary heat source side and the four-position selector valve (22). The by-pass line (BPL) is branched into two lines in the middle. A check valve (CV-B1) and an outlet-side solenoid valve (SV-B1) allowing only the refrigerant to flow from the compressor (11) to the heat exchanger (12A) on the primary heat source side are provided for one of the branch pipes. A check valve (CV-B2) and an inlet-side solenoid valve (SV-B2) allowing only the refrigerant to flow from the heat exchanger (12A) on the primary heat source side to the compressor (11) are provided for the other branch pipe.

Moreover, the primary refrigerant circuit (A) is switched in accordance with the selection operation of the four-position selector valve (22) between a state in which the outdoor heat exchanger (14) is connected to the outlet side of the compressor (11) and the heat exchanger (12A) on the primary heat source side is connected to the inlet side of the compressor (11) (i.e., the state indicated by the solid lines in FIG. 1) and a state in which the outdoor heat exchanger (14) is connected to the inlet side of the compressor (11) and the heat exchanger (12A) on the primary heat source side is connected to the outlet side of the compressor (11) (i.e., the state indicated by the broken lines in FIG. 1).

On the other hand, the secondary refrigerant circuit (B) has the same construction as that described in the first embodiment.

The opening/closing states of the solenoid valves (SV1, SV2, SV-B1, SV-B2), the electrically motorized expansion valves (EVW, 13, EV1) and the four-position selector valve (22) are controlled by a controller (C).

Next, the room cooling running operation of the refrigerant circuits (A, B) having the above-described construction will be described.

When the cooling running is started, the four-position selector valve (22) is firstly switched to the direction indicated by the solid lines, the opening degree of the first electrically motorized expansion valve (EVW) is adjusted at a predetermined degree and the second electrically motorized expansion valve (13) is fully opened in the primary refrigerant circuit (A). In the by-pass line (BPL), the inlet-side solenoid valve (SV-B2) is opened and the outlet-side solenoid valve (SV-B1) is closed. In the secondary refrigerant circuit (B), the first solenoid valve (SV1) is opened and the second solenoid valve (SV2) is closed.

In such a state, the compressor (11) is driven. Then, in the primary refrigerant circuit (A) as indicated by the solid-line arrows in FIG. 19, a high-temperature, high-pressure gaseous refrigerant discharged from the compressor (11) exchanges heat with the outdoor air in the outdoor heat exchanger (14) and is condensed. The pressure of the refrigerant is reduced in the first electrically motorized expansion valve (EVW). Then, the refrigerant exchanges heat in the heat exchanger (12A) on the primary heat source side with the heat exchanger (1) on the secondary heat source side, and the refrigerant extracts heat from the refrigerant in the heat exchanger (1) on the secondary heat source side and is evaporated to return to the compressor (11) through the by-pass line (BPL). This circulation operation is repeated.

On the other hand, in the secondary refrigerant circuit (B), the refrigerant of the heat exchanger (1) on the secondary heat source side, the heat of which has been extracted because of the heat exchange with the heat exchanger (12A) on the primary heat source side, is condensed as indicated by the one-dot-chain arrows in FIG. 19. As a result, the internal pressure of the heat exchanger (1) on the secondary heat source side falls. Owing to a difference in pressure between the heat exchanger (1) on the secondary heat source side and the indoor heat exchanger (3), the gaseous refrigerant in the indoor heat exchanger (3) is recovered into the heat exchanger (1) on the secondary heat source side through the gas pipe (6). The gaseous refrigerant recovered into the heat exchanger (1) on the secondary heat source side is cooled by the refrigerant flowing through the heat exchanger (12A) on the primary heat source side so as to be a liquid refrigerant, which is reserved in the heat exchanger (1) on the secondary heat source side.

After this operation has been performed, a switching operation is performed in each of the refrigerant circuits (A, B). The first electrically motorized expansion valve (EVW) is fully opened and the opening degree of the second electrically motorized expansion valve (13) is adjusted at a predetermined degree. In the by-pass line (BPL), both the solenoid valves (SV-B1, SV-B2) are closed. In the secondary refrigerant circuit (B), the first solenoid valve (SV1) is closed and the second solenoid valve (SV2) and the indoor electrically motorized expansion valve (EV1) are opened.

As a result, in the primary refrigerant circuit (A) as indicated by the broken-line arrows in FIG. 19, the high-temperature, high-pressure gaseous refrigerant discharged from the compressor (11) exchanges heat with the outdoor air in the outdoor heat exchanger (14) and is condensed. Thereafter, the refrigerant exchanges heat in the heat exchanger (12A) on the primary heat source side with the heat exchanger (1) on the secondary heat source side. After the refrigerant has fallen into an excessively cooled state while applying heat to the refrigerant in the heat exchanger (1) on the secondary heat source side, the pressure of the refrigerant is reduced in the second electrically motorized expansion valve (13). The refrigerant exchanges heat with the outdoor air in the auxiliary heat exchanger (15A) and is evaporated to return to the compressor (11). This circulation operation is repeated.

On the other hand, in the secondary refrigerant circuit (B), a part of the refrigerant of the heat exchanger (1) on the secondary heat source side, to which heat has been applied because of the heat exchange with the heat exchanger (12A) on the primary heat source side, is evaporated as indicated by the two-dot-chain arrows in FIG. 19. As a result, the internal pressure of the heat exchanger (1) on the secondary heat source side rises. Owing to a difference in pressures between the heat exchanger (1) on the secondary heat source side and the indoor heat exchanger (3), the liquid refrigerant in the heat exchanger (1) on the secondary heat source side is pushed from the lower part of the heat exchanger (1) on the secondary heat source side into the indoor heat exchanger (3) through the liquid pipe (7). The pressure of the liquid refrigerant pushed into the indoor heat exchanger (3) is reduced in the indoor electrically motorized expansion valve (EV1). Thereafter, the liquid refrigerant exchanges heat with the indoor air in the indoor heat exchanger (3) and is evaporated, thereby cooling the indoor air.

The switching operations are alternately performed in the respective refrigerant circuits (A, B) in the above-described manner. As a result, the refrigerant circulates in the secondary refrigerant circuit (B), thereby cooling the indoor air. Thus, in the heat transport system of this embodiment, heat can be transported in the secondary refrigerant circuit (B) without providing any driving source such as a pump for the secondary refrigerant circuit (B).

Next, the heating running will be described with reference to FIG. 20.

In the heating running, the four-position selector valve (22) is firstly switched to the direction indicated by the broken lines, the first electrically motorized expansion valve (EV1) is fully opened and the opening degree of the second electrically motorized expansion valve (13) is adjusted at a predetermined degree in the primary refrigerant circuit (A). In the by-pass line (BPL), both the solenoid valves (SV-B1, SV-B2) are closed. In the secondary refrigerant circuit (B), the first solenoid valve (SV1) is closed and the second solenoid valve (SV2) is opened.

Figure 20:
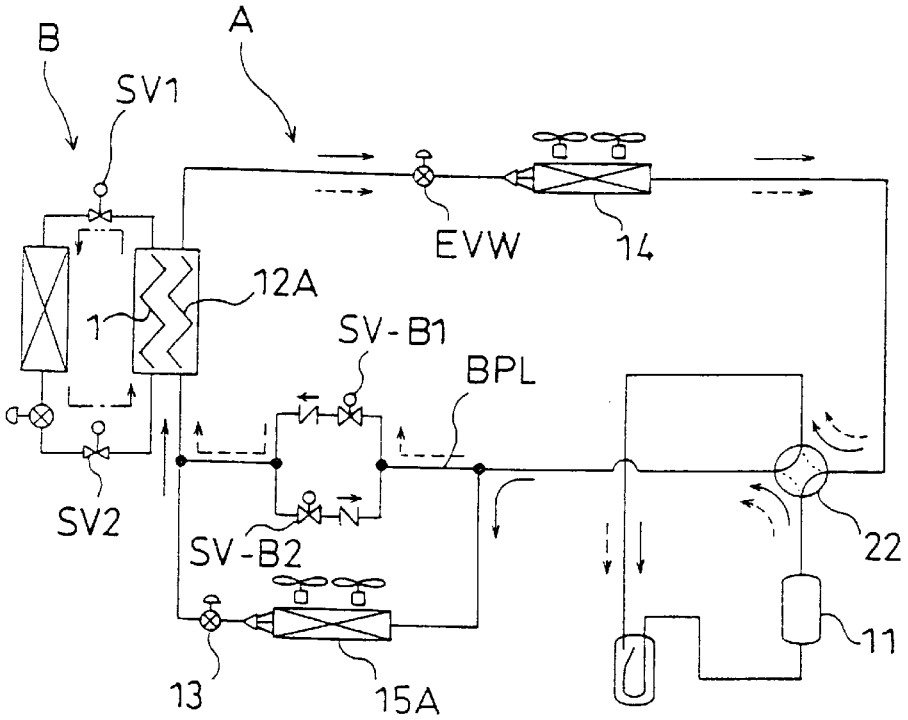
FIG. 20 is a diagram corresponding to FIG. 1 and showing a heating running condition in the thirteenth embodiment.

Then, in the primary refrigerant circuit (A) as indicated by the solid-line arrows in FIG. 20, the high-temperature, high-pressure gaseous refrigerant discharged from the compressor (11) exchanges heat with the outdoor air and is condensed in the auxiliary heat exchanger (15A). Thereafter, the pressure of the refrigerant is reduced in the second electrically motorized expansion valve (13). Then, the refrigerant exchanges heat in the heat exchanger (12A) on the primary heat source side with the heat exchanger (1) on the secondary heat source side and is evaporated to return to the compressor (11) through the outdoor heat exchanger (14). This circulation operation is repeated.

On the other hand, in the secondary refrigerant circuit (B), the refrigerant of the heat exchanger (1) on the secondary heat source side, the heat of which has been extracted because of the heat exchange with the heat exchanger (12) on the primary heat source side, is condensed as indicated by the one-dot-chain arrows in FIG. 20. As a result, the internal pressure of the heat exchanger (1) on the secondary heat source side falls. Owing to a difference in pressure between the heat exchanger (1) on the secondary heat source side and the indoor heat exchanger (3), the liquid refrigerant in the indoor heat exchanger (3) is recovered into the heat exchanger (1) on the secondary heat source side through the liquid pipe (7).

After this operation has been performed, a switching operation is performed in each of the refrigerant circuits (A, B). The opening degree of the first electrically motorized expansion valve (EVW) is adjusted at a predetermined degree and the second electrically motorized expansion valve (13) is fully opened. In the by-pass line (BPL), the outlet-side solenoid valve (SV-B1) is opened and the inlet-side solenoid valve (SV-B2) is closed. In the secondary refrigerant circuit (B), the first solenoid valve (SV1) is opened and the second solenoid valve (SV2) is closed.

Then, in the primary refrigerant circuit (A) as indicated by the broken-line arrows, the high-temperature, high-pressure gaseous refrigerant discharged from the compressor (11) is passed through the by-pass line (BPL). The refrigerant exchanges heat in the heat exchanger (12A) on the primary heat source side with the refrigerant in the heat exchanger (1) on the secondary heat source side and is condensed. Thereafter, the pressure of the refrigerant is reduced in the first electrically motorized expansion valve (EVW). The refrigerant is evaporated in the outdoor heat exchanger (14) to return to the compressor (11). This circulation operation is repeated.

On the other hand, in the secondary refrigerant circuit (B) as indicated by the two-dot-chain arrows in FIG. 20, the refrigerant of the heat exchanger (1) on the secondary heat source side, to which heat has been applied because of the heat exchange with the heat exchanger (12A) on the primary heat source side, is evaporated. As a result, the internal pressure of the heat exchanger (1) on the secondary heat source side rises. Owing to a difference in pressures between the heat exchanger (1) on the secondary heat source side and the indoor heat exchanger (3), the gaseous refrigerant in the heat exchanger (1) on the secondary heat source side is supplied from the upper part of the heat exchanger (1) on the secondary heat source side to the indoor heat exchanger (3) through the gas pipe (6). Thereafter, the gaseous refrigerant supplied to the indoor heat exchanger (3) exchanges heat with the indoor air in the indoor heat exchanger (3) and is condensed, thereby heating the indoor air.

The switching operations are alternately performed in the respective refrigerant circuits (A, B) in the above-described manner. Thus, the refrigerant circulates in the secondary refrigerant circuit (B), thereby heating the indoor air. That is to say, even during this heating running, heat can be transported in the secondary refrigerant circuit (B) without providing any driving source such as a pump for the secondary refrigerant circuit (B).

Moreover, in the construction of this embodiment, the liquid refrigerant condensed in the outdoor heat exchanger (14) during the room cooling running can be cooled in the heat exchanger (12A) on the primary heat source side until the refrigerant reaches the excessively cooled state. Thus, the efficiency of the primary refrigerant circuit (A) can be improved.

In this embodiment, a case of combining it with the secondary refrigerant circuit (B) of the first embodiment has been described. Alternatively, it may be combined with the secondary refrigerant circuit (B) of any other embodiment.

(Fourteenth Embodiment)

Next, the fourteenth embodiment will be described with reference to FIGS. 21 and 22. This embodiment is a variant of the primary refrigerant circuit (A) to be combined with the secondary refrigerant circuit (B) of the tenth embodiment described above, and is applied to an air conditioning system which is selectable between cooling running and heating running.

The primary refrigerant circuit (A) of this embodiment is constructed by connecting a compressor (11), two (first and second) four-position selector valves (22A, 22B), an outdoor heat exchanger (14), an electrically motorized expansion valve (EV), a first heat exchanger (12A-1) on the primary heat source side and a second heat exchanger (12A-2) on the primary heat source side to each other through a refrigerant pipe (16).

Figure 21:
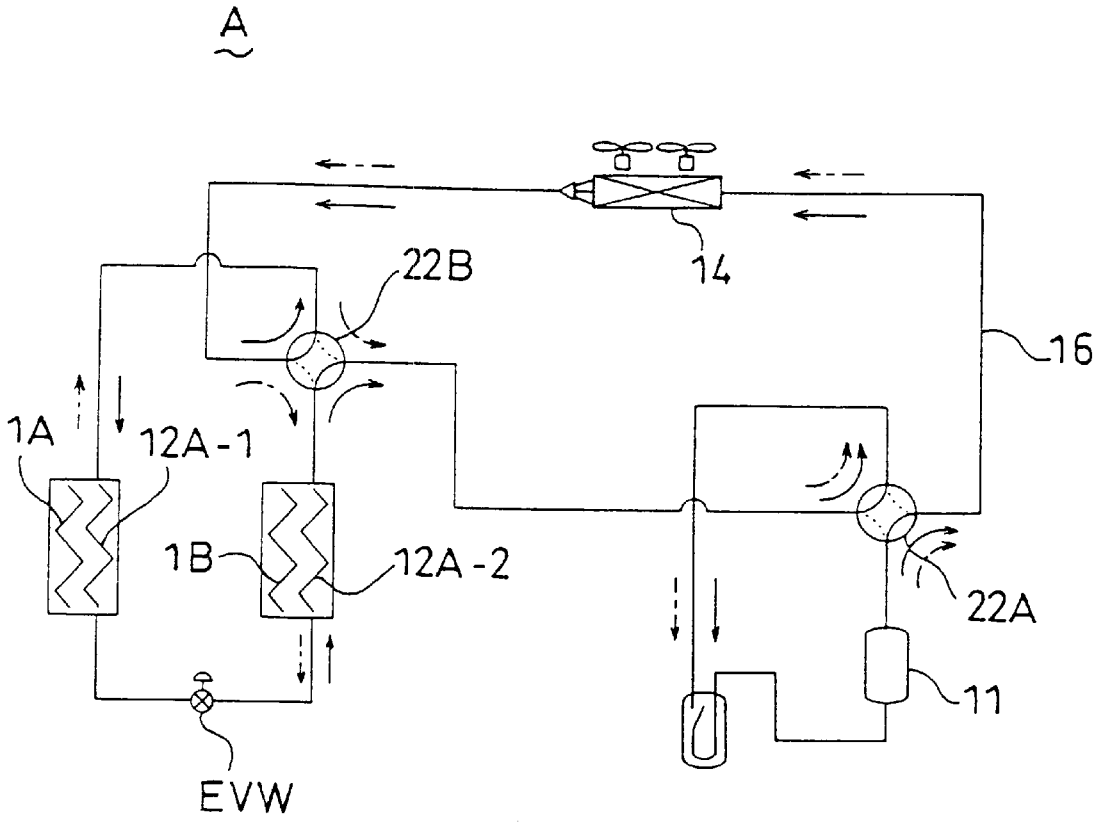
FIG. 21 is a diagram showing a cooling running condition in the fourteenth embodiment.

The primary refrigerant circuit (A) is switched in accordance with the selection operation of the first four-position selector valve (22A) between a state in which the outdoor heat exchanger (14) is connected to the outlet side of the compressor (11) (a state indicated by the solid lines in FIG. 21) and a state in which the outdoor heat exchanger (14) is connected to the inlet side of the compressor (11) (i.e., the state indicated by the broken lines in FIG. 21).

Moreover, the primary refrigerant circuit (A) is switched in accordance with the selection operation of the second four-position selector valve (22B) between a state in which the first heat exchanger (12A-1) on the primary heat source side is connected to the outdoor heat exchanger (14) and the second heat exchanger (12A-2) on the primary heat source side is connected to the compressor (11) (a state indicated by the solid lines in FIG. 21) and a state in which the first heat exchanger (12A-1) on the primary heat source side is connected to the compressor (11) and the second heat exchanger (12A-2) on the primary heat source side is connected to the outdoor heat exchanger (14) (a state indicated by the broken lines in FIG. 21).

The secondary refrigerant circuit (B) has the same construction as that described in the tenth embodiment. The heat exchanger (1A) on the secondary heat source side located on the left-hand side in FIG. 12 exchanges heat with the first heat exchanger (12A-1) on the primary heat source side, and the heat exchanger (1B) on the secondary heat source side located on the right-hand side exchanges heat with the second heat exchanger (12A-2) on the primary heat source side.

Next, the cooling running of the refrigerant circuits (A, B) having the above-described construction will be described.

When the cooling running is started, both the first four-position selector valve (22A) and the second four-position selector valve (22B) are firstly switched to the direction indicated by the solid lines and the opening degree of the electrically motorized expansion valve (EVW) is adjusted at a predetermined degree in the primary refrigerant circuit (A). On the other hand, in the secondary refrigerant circuit (B), the solenoid valve (SVC-1) coupled to the heat exchanger (1B) on the secondary heat source side located on the right-hand side and the solenoid valve (SVC-2) coupled to the heat exchanger (1A) on the secondary heat source side located on the left-hand side are opened and the other solenoid valves are closed.

In such a state, the compressor (11) is driven. Then, in the primary refrigerant circuit (A) as indicated by the solid-line arrows in FIG. 21, a high-temperature, high-pressure gaseous refrigerant discharged from the compressor (11) exchanges heat with the outdoor air in the outdoor heat exchanger (14) and is condensed. Then, the refrigerant exchanges heat in the first heat exchanger (12A-1) on the primary heat source side with one heat exchanger (1A) on the secondary heat source side. And the refrigerant applies heat to the refrigerant in the heat exchanger (1A) on the secondary heat source side so as to be excessively cooled. Thereafter, the pressure of the liquid refrigerant is reduced in the solenoid valve (EVW). The refrigerant exchanges heat in the second primary heat exchanger (12A-2) on the primary heat source side with the other heat exchanger (1B) on the secondary heat source side. The refrigerant extracts heat from the refrigerant in the heat exchanger (1B) on the secondary heat source side and is evaporated to return to the compressor (11). This circulation operation is repeated.

On the other hand, in the secondary refrigerant circuit (B), the heat exchanger (1B) on the secondary heat source side, located on the right-hand side, falls into the heat-radiation state and the gaseous refrigerant is recovered from the indoor heat exchanger (3) through the gas pipe (6) in the same way as in the tenth embodiment described above. In the meantime, the first heat exchanger (1*a*) on the secondary heat source side of the heat exchanger (1A) on the secondary heat source side, located on the left-hand side, falls into the heat-absorption state. Owing to the rise in internal pressure caused by the evaporation of the refrigerant, the second heat exchanger (1*b*) on the secondary heat source side supplies the liquid refrigerant to the indoor heat exchanger (3) through the liquid pipe (7).

After such an operation has been performed for a predetermined time, the respective refrigerant circuits (A, B) are switched. Specifically, in the primary refrigerant circuit (A), the second four-position selector valve (22B) is switched to the direction indicated by the broken lines. In the secondary refrigerant circuit (B), the solenoid valve (SVC-2) coupled to the heat exchanger (1B) on the secondary heat source side located on the right-hand side and the solenoid valve (SVC-1) coupled to the heat exchanger (1A) on the secondary heat source side located on the left-hand side are opened and the other solenoid valves are closed.

In such a state, in the primary refrigerant circuit (A) as indicated by the one-dot-chain arrows in FIG. 21, the high-temperature, high-pressure gaseous refrigerant discharged from the compressor (11) exchanges heat with the outdoor air in the outdoor heat exchanger (14) and is condensed. Thereafter, the refrigerant exchanges heat in the second heat exchanger (12A-2) on the primary heat source side with one heat exchanger (1B) on the secondary heat source side. The refrigerant applies heat to the refrigerant in the heat exchanger (1B) on the secondary heat source side so as to fall into an excessively cooled state. Thereafter, the pressure of the liquid refrigerant is reduced in the electrically motorized expansion valve (EVW). The refrigerant exchanges heat in the first heat exchanger (12A-1) on the primary heat source side with the other heat exchanger (1A) on the secondary heat source side and is evaporated while extracting heat from the refrigerant in the heat exchanger (1A) on the secondary heat source side. Thereafter, the refrigerant returns to the compressor (11). This circulation operation is repeated.

On the other hand, in the secondary refrigerant circuit (B), the heat exchanger (1A) on the secondary heat source side located on the left-hand side falls into a heat-radiation state, and recovers the liquid refrigerant from the indoor heat exchanger (3). In the meantime, the first heat exchanger (1*a*) on the secondary heat source side of the heat exchanger (1B) on the secondary heat source side located on the right-hand side falls into the heat-absorption state. Owing to the rise in internal pressure caused by the evaporation of the refrigerant, the second heat exchanger (1*b*) on the secondary heat source side supplies the liquid refrigerant to the indoor heat exchanger (3).

The heat-radiation state and the heat-absorption state are alternately repeated in both the heat exchangers (1A, 1B) on the secondary heat source side. As a result, the room cooling can be performed continuously and the air conditioning performance can be improved.

Next, the room heating running of the refrigerant circuits (A, B) having the above-described construction will be described.

When the heating running is started, first, the first four-position selector valve (22A) is switched to the direction indicated by the broken lines and the second four-position selector valve (22B) is switched to the direction indicated by the solid lines and the opening degree of the electrically motorized expansion valve (EVW) is adjusted at a predetermined degree in the primary refrigerant circuit (A). On the other hand, in the secondary refrigerant circuit (B), the solenoid valve (SVW-1) coupled to the heat exchanger (1B) on the secondary heat source side located on the right-hand side and the solenoid valve (SVW-2) coupled to the heat exchanger (1A) on the secondary heat source side located on the left-hand side are opened and the other solenoid valves are closed.

In such a state, the compressor (11) is driven. Then, in the primary refrigerant circuit (A) as indicated by the solid-line arrows in FIG. 22, the high-temperature, high-pressure gaseous refrigerant discharged from the compressor (11) exchanges heat in the second heat exchanger (12A-2) on the primary heat source side with one heat exchanger (1B) on the secondary heat source side and is condensed. Thereafter, the pressure of the liquid refrigerant is reduced in the electrically motorized expansion valve (EVW). The refrigerant exchanges heat in the first primary heat exchanger (12A-1) on the primary heat source side with the other heat exchanger (1A) on the secondary heat source side and is evaporated to return to the compressor (11) through the outdoor heat exchanger (14). This circulation operation is repeated.

On the other hand, in the secondary refrigerant circuit (B), the heat exchanger (1A) on the secondary heat source side, located on the left-hand side, falls into the heat-radiation state and the liquid refrigerant is recovered from the indoor heat exchanger (3). In the meantime, the heat exchanger (1B) on the secondary heat source side, located on the right-hand side, falls into the heat-absorption state. Owing to the rise in internal pressure caused by the evaporation of the refrigerant, the gaseous refrigerant is supplied to the indoor heat exchanger (3).

After such an operation has been performed for a predetermined time, the respective refrigerant circuits (A, B) are switched. Specifically, in the primary refrigerant circuit (A), the second four-position selector valve (22B) is switched to the direction indicated by the broken lines. In the secondary refrigerant circuit (B), the solenoid valve (SVW-2) coupled to the heat exchanger (1B) on the secondary heat source side located on the right-hand side and the solenoid valve (SVW-1) coupled to the heat exchanger (1A) on the secondary heat source side located on the left-hand side are opened and the other solenoid valves are closed.

Figure 22:
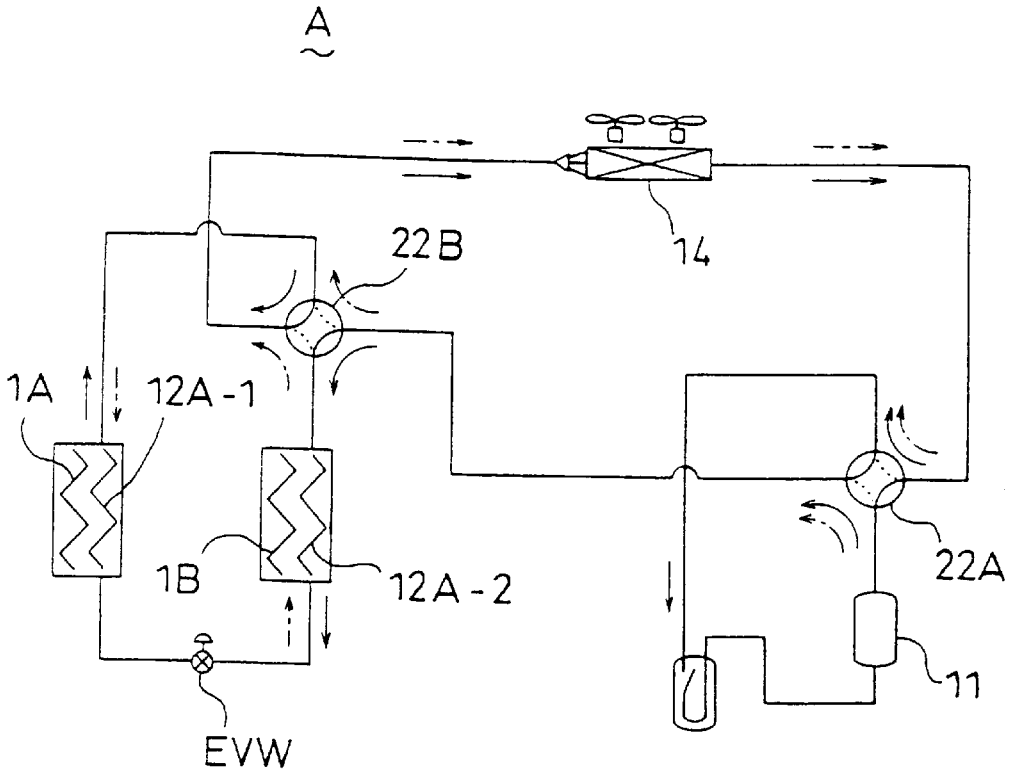
FIG. 22 is a diagram showing a heating running condition in the fourteenth embodiment.

In such a state, in the primary refrigerant circuit (A) as indicated by the one-dot-chain arrows in FIG. 22, the high-temperature, high-pressure gaseous refrigerant discharged from the compressor (11) exchanges heat in the first heat exchanger (12A-1) on the primary heat source side with one heat exchanger (1A) on the secondary heat source side and is condensed. Thereafter, the pressure of the liquid refrigerant is reduced in the electrically motorized expansion valve (EVW). The refrigerant exchanges heat in the second heat exchanger (12A-2) on the primary heat source side with the other heat exchanger (1B) on the secondary heat source side and is evaporated. Thereafter, the refrigerant returns to the compressor (11) through the outdoor heat exchanger (14). This circulation operation is repeated.

On the other hand, in the secondary refrigerant circuit (B), the heat exchanger (1A) on the secondary heat source side located on the left-hand side falls into a heat-absorption state, and supplies the liquid refrigerant to the indoor heat exchanger (3) owing to the rise in internal pressure caused by the evaporation of the refrigerant. In the meantime, the first heat exchanger (1*a*) on the secondary heat source side of the heat exchanger (1B) on the secondary heat source side located on the right-hand side falls into the heat-radiation state, thereby recovering the liquid refrigerant from the indoor heat exchanger (3).

The heat-radiation state and the heat-absorption state are alternately repeated in both the heat exchangers (1A, 1B) on the secondary heat source side. As a result, the room cooling can be performed continuously and the air conditioning performance can be improved.

In this embodiment, a case of combining it with the secondary refrigerant circuit (B) of the tenth embodiment has been described. Alternatively, it may be combined with the secondary refrigerant circuit (B) of any other embodiment.

(Other Embodiments)

In the foregoing embodiments, various cases where the heat transport system according to the present invention is applied to refrigerant circuitry for an air conditioning system have been described. However, the present invention is not limited thereto, but is applicable to various other refrigerating machines.

Industrial Applicability

As described above, the present invention is effectively applicable to a heat transport system usable as refrigerant circuitry for an air conditioning system, and more particularly applicable to a heat transport system for transporting heat by circulating a heat transport medium without requiring any driving source such as a pump.

We claim:

1. A heat transport system, characterized by comprising:

heat exchange means (1) on a heat source side;

heat exchange means (3) on an application side;

a gas pipe (6) for connecting upper ends of the heat exchange means (1) on the heat source side and the heat exchange means (3) on the application side;

a liquid pipe (7) for connecting lower ends of the heat exchange means (1) on the heat source side and the heat exchange means (3) on the application side;

heat source means (A) for alternately performing a heating operation for raising an internal pressure of the heat exchange means (1) on the heat source side by applying heat to a refrigerant in the heat exchange means (1) on the heat source side and a heat-absorbing operation for lowering the internal pressure of the heat exchange means (1) on the heat source side by extracting heat from the refrigerant in the heat exchange means (1) on the heat source side; and refrigerant control means (G) for performing heat absorption running or heat radiation running on the heat exchange means (3) on the application side by allowing the refrigerant to flow through one of the gas pipe (6) and the liquid pipe (7) and preventing the refrigerant from flowing through the other pipe in accordance with whether the heat source means (A) performs the heating operation or the heat-absorbing operation, thereby supplying the refrigerant from the heat exchange means (1) on the heat source side to the heat exchange means (3) on the application side during the heating operation of the heat source means (A) and recovering the refrigerant from the heat exchange means (3) on the application side to the heat exchange means (1) on the heat source side during the heat-absorbing operation of the heat source means (A).

2. The heat transport system of claim 1, characterized in that, in performing the heat absorption running on the heat exchange means (3) on the application side, the refrigerant control means (G) allows a liquid refrigerant to be supplied from the heat exchange means (1) on the heat source side to the heat exchange means (3) on the application side through the liquid pipe (7) and prevents a gaseous refrigerant from being recovered from the heat exchange means (3) on the application side to the heat exchange means (1) on the heat source side through the gas pipe (6) during the heating operation of the heat source means (A), and allows the gaseous refrigerant to be recovered from the heat exchange means (3) on the application side to the heat exchange means (1) on the heat source side through the gas pipe (6) and prevents a liquid refrigerant from being supplied from the heat exchange means (1) on the heat source side to the heat exchange means (3) on the application side through the liquid pipe (7) during the heat-absorbing operation of the heat source means (A).

3. The heat transport system of claim 1, characterized in that, in performing the heat radiation running on the heat exchange means (3) on the application side, the refrigerant control means (G) allows a gaseous refrigerant to be supplied from the heat exchange means (1) on the heat source side to the heat exchange means (3) on the application side through the gas pipe (6) and prevents a liquid refrigerant from being recovered from the heat exchange means (3) on the application side to the heat exchange means (1) on the heat source side through the liquid pipe (7) during the heating operation of the heat source means (A), and allows the liquid refrigerant to be recovered from the heat exchange means (3) on the application side to the heat exchange means (1) on the heat source side through the liquid pipe (7) and prevents a gaseous refrigerant from being supplied from the heat exchange means (1) on the heat source side to the heat exchange means (3) on the application side through the gas pipe (6) during the heat-absorbing operation of the heat source means (A).

4. The heat transport system of claim 1, characterized in that the heat exchange means (1) on the heat source side includes at least one first heat exchanger **(1*a*) and at least one second heat exchanger (1*b*), which are connected in parallel to each other, and that, while the heat source means (A) performs the heating operation during the heat absorption running of the heat exchange means (3) on the application side, only the first heat exchanger (1*a*) is heated to raise an internal pressure of the first heat exchanger (1*a*) and the pressure is applied onto the second heat exchanger (1*b*), thereby supplying a liquid refrigerant from the second heat exchanger (1*b*) to the heat exchange means (3) on the application side through the liquid pipe (7)**.

5. The heat transport system of claim 1, characterized in that the heat exchange means (1) on the heat source side includes at least one first heat exchanger **(1*a*) and at least one second heat exchanger (1*b*), which are connected in parallel to each other, and that, while the heat source means (A) performs the heat-absorbing operation during the heat radiation running of the heat exchange means (3) on the application side, heat is absorbed only from the first heat exchanger (1*a*) to lower an internal pressure of the first heat exchanger (1*a*) and the pressure is applied onto the second heat exchanger (1*b*), thereby recovering a liquid refrigerant from the heat exchange means (3) on the application side to the second heat exchanger (1*b*) through the liquid pipe (7)**.

6. The heat transport system of claim 2 or 4, characterized in that the refrigerant control means (G) includes:

a first solenoid valve (SV1), which is provided for the gas pipe (6), opens during the heat-absorbing operation of the heat source means (A) and closes during the heating operation of the heat source means (A); and a second solenoid valve (SV2), which is provided for the liquid pipe (7), opens during the heating operation of the heat source means (A) and closes during the heat-absorbing operation of the heat source means (A).

7. The heat transport system of claim 3 or 5, characterized in that the refrigerant control means (G) includes:

a first solenoid valve (SV1), which is provided for the gas pipe (6), opens during the heating operation of the heat source means (A) and closes during the heat-absorbing operation of the heat source means (A); and a second solenoid valve (SV2), which is provided for the liquid pipe (7), opens during the heat-absorbing operation of the heat source means (A) and closes during the heating operation of the heat source means (A).

8. The heat transport system of claim 2 or 4, characterized in that the refrigerant control means (G) includes:

a first check valve (CV1), which is provided for the gas pipe (6) and allows only the gaseous refrigerant to flow from the heat exchange means (3) on the application side to the heat exchange means (1) on the heat source side; and a second check valve (CV2), which is provided for the liquid pipe (7) and allows only the liquid refrigerant to flow from the heat exchange means (1) on the heat source side to the heat exchange means (3) on the application side.

9. The heat transport system of claim 3 or 5, characterized in that the refrigerant control means (G) includes:

a first check valve (CV3), which is provided for the gas pipe (6) and allows only the gaseous refrigerant to flow from the heat exchange means (1) on the heat source side to the heat exchange means (3) on the application side; and a second check valve (CV4), which is provided for the liquid pipe (7) and allows only the liquid refrigerant to flow from the heat exchange means (3) on the application side to the heat exchange means (1) on the heat source side.

10. The heat transport system of claim 1, 2, 3 or 4, characterized by further comprising reservoir means (20), which is connected in parallel to the heat exchange means (1) on the heat source side and recovers the liquid refrigerant in the heat exchange means (1) on the heat source side.

11. A heat transport system, characterized by comprising:

at least one first heat exchange section (1A) on a heat source and at least one second heat exchange section (1B) on the heat source side;

heat exchange means (3) on an application side;

a plurality of gas pipes (6*a*, 6*b*) for connecting upper ends of the respective heat exchange sections (1A, 1B) on the heat source side to an upper end of the heat exchange means (3) on the application side;

a plurality of liquid pipes (7*a*, 7*b*) for connecting lower ends of the respective heat exchange sections (1A, 1B) on the heat source side to a lower end of the heat exchange means (3) on the application side;

heat source means (A) for alternately performing a first heat exchange operation for raising an internal pressure of the first heat exchange section (1A) on the heat source side by applying heat to a refrigerant in the first heat exchange section (1A) on the heat source side and for lowering an internal pressure of the second heat exchange section (1B) on the heat source side by extracting heat from a refrigerant in the second heat exchange section (1B) on the heat source side, and a second heat exchange operation for lowering the internal pressure of the first heat exchange section (1A) on the heat source side by extracting heat from the refrigerant in the first heat exchange section (1A) on the heat source side and for raising the internal pressure of the second heat exchange section (1B) on the heat source side by applying heat to the refrigerant in the second heat exchange section (1B) on the heat source side; and refrigerant control means (G) for performing heat absorption running or heat radiation running on the heat exchange means (3) on the application side by switching flow conditions of the refrigerant in the gas pipes (6*a*, 6*b*) and the liquid pipes (7*a*, 7*b*) in accordance with the heat exchange operation of the heat source means (A), thereby supplying the refrigerant from the first heat exchange section (1A) on the heat source side to the heat exchange means (3) on the application side and recovering the refrigerant from the heat exchange means (3) on the application side to the second heat exchange section (1B) on the heat source side during the first heat exchange operation of the heat source means (A), and thereby supplying the refrigerant from the second heat exchange section (1B) on the heat source side to the heat exchange means (3) on the application side and recovering the refrigerant from the heat exchange means (3) on the application side to the first heat exchange section (1A) on the heat source side during the second heat exchange operation of the heat source means (A).

12. The heat transport system of claim 11, characterized in that, in performing the heat absorption running on the heat exchange means (3) on the application side, the refrigerant control means (G) switches the flow conditions of the refrigerant in the gas pipes (6*a*, 6*b*) and the liquid pipes (7*a*, 7*b*) so as to supply a liquid refrigerant from the first heat exchange section (1A) on the heat source side, heated by the heat source means (A), to the heat exchange means (3) on the application side through the liquid pipe (7*a*) and to recover a gaseous refrigerant from the heat exchange means (3) on the application side to the second heat exchange section (1B) on the heat source side, heat of which is absorbed by the heat source means (A), through the gas pipe (6*b*) during the first heat exchange operation of the heat source means (A), and switches the flow conditions of the refrigerant in the gas pipes (6*a*, 6*b*) and the liquid pipes (7*a*, 7*b*) so as to supply a liquid refrigerant from the second heat exchange section (1B) on the heat source side, heated by the heat source means (A), to the heat exchange means (3) on the application side through the liquid pipe (7*b*) and to recover a gaseous refrigerant from the heat exchange means (3) on the application side to the first heat exchange section (1A) on the heat source side, heat of which is absorbed by the heat source means (A), through the gas pipe (6*a*) during the second heat exchange operation of the heat source means (A).

13. The heat transport system of claim 11, characterized in that, in performing the heat radiation running on the heat exchange means (3) on the application side, the refrigerant control means (G) switches the flow conditions of the refrigerant in the gas pipes (6*a*, 6*b*) and the liquid pipes (7*a*, 7*b*) so as to supply a gaseous refrigerant from the first heat exchange section (1A) on the heat source side, heated by the heat source means (A), to the heat exchange means (3) on the application side through the gas pipe (6*a*) and to recover a liquid refrigerant from the heat exchange means (3) on the application side to the second heat exchange section (1B) on the heat source side, heat of which is absorbed by the heat source means (A), through the liquid pipe (7*b*) during the first heat exchange operation of the heat source means (A), and switches the flow conditions of the refrigerant in the gas pipes (6*a*, 6*b*) and the liquid pipes (7*a*, 7*b*) so as to supply a gaseous refrigerant from the second heat exchange section (1B) on the heat source side, heated by the heat source means (A), to the heat exchange means (3) on the application side through the gas pipe (6*b*) and to recover a liquid refrigerant from the heat exchange means (3) on the application side to the first heat exchange section (1A) on the heat source side, heat of which is absorbed by the heat source means (A), through the liquid pipe (7*a*) during the second heat exchange operation of the heat source means (A).

14. The heat transport system of claim 11 or 12, characterized in that each of the heat exchange sections (1A, 1B) on the heat source side includes at least one first heat exchanger (1*a*) and at least one second heat exchanger (1*b*), which are connected in parallel to each other, and that, in the heat exchange section (1A, 1B) on the heat source side that receives heat from the heat source means (A) during the heat absorption running of the heat exchange means (3) on the application side, only the first heat exchanger (1*a*) is heated to raise an internal pressure of the first heat exchanger (1*a*) and the pressure is applied onto the second heat exchanger (1*b*), thereby supplying a liquid refrigerant from the second heat exchanger (1*b*) to the heat exchange means (3) on the application side through the liquid pipe (7).

15. The heat transport system of claim 11 or 13, characterized in that each of the heat exchange sections (1A, 1B) on the heat source side includes at least one first heat exchanger (1*a*) and at least one second heat exchanger (1*b*), which are connected in parallel to each other, and that, in the heat exchange section (1A, 1B) on the heat source side, from which heat is extracted by the heat source means (A) during the heat radiation running of the heat exchange means (3) on the application side, only the first heat exchanger (1*a*) is cooled to lower an internal pressure of the heat exchanger (1*a*) and the pressure is applied onto the second heat exchanger (1*b*), thereby recovering a liquid refrigerant from the heat exchange means (3) on the application side to the heat exchanger (1*b*) through the liquid pipe (7).

* * * * *